US012049753B2

(12) United States Patent
Chapman

(10) Patent No.: US 12,049,753 B2
(45) Date of Patent: Jul. 30, 2024

(54) MODULAR STRUCTURE AND CONNECTION METHOD

(71) Applicant: Peter Dann Ltd., London (GB)

(72) Inventor: Peter Chapman, London (GB)

(73) Assignee: Peter Dann Limited, London (GB)

( * ) Notice: Subject to any disclaimer, the term of this patent is extended or adjusted under 35 U.S.C. 154(b) by 199 days.

(21) Appl. No.: 17/604,430

(22) PCT Filed: Nov. 29, 2019

(86) PCT No.: PCT/GB2019/053378

§ 371 (c)(1),
(2) Date: Oct. 17, 2021

(87) PCT Pub. No.: WO2020/212677

PCT Pub. Date: Oct. 22, 2020

(65) Prior Publication Data

US 2022/0205235 A1 Jun. 30, 2022

(30) Foreign Application Priority Data

Apr. 17, 2019 (GB) ..... 1905434

(51) Int. Cl.
*E04B 1/348* (2006.01)
*E04B 1/30* (2006.01)
(Continued)

(52) U.S. Cl.
CPC ..... *E04B 1/34853* (2013.01); *E04B 1/30* (2013.01); *E04G 21/142* (2013.01); *E04H 1/005* (2013.01)

(58) Field of Classification Search
None
See application file for complete search history.

(56) References Cited

U.S. PATENT DOCUMENTS 3,652,118 A * 3/1972 Goldberg ..... E04B 1/41 294/96
5,735,639 A * 4/1998 Payne ..... B65D 90/0013 588/259
(Continued)

FOREIGN PATENT DOCUMENTS

CN 204491840 U * 7/2015
CN 204491840 U 7/2015
(Continued)

OTHER PUBLICATIONS

Combined Search and Examination Report issued for GB 1905434.5, Dated Sep. 2, 2019, 5 pages.
(Continued)

*Primary Examiner* — Joshua K Ihezie
(74) *Attorney, Agent, or Firm* — Bochner PLLC; Andrew D. Bochner

(57) ABSTRACT

A modular unit for constructing a modular structure is described. The modular unit comprises a structural frame, which includes at least one upper beam, at least one lower beam, and at least one column extending between said upper and lower beams and connected therebetween. At least one of said upper or lower beams is arranged to define at least one chamber for receiving a building material therein along at least a portion of its length, said column being connected to said portion of said beam. Part of said beam is removed along said portion of said beam to define at least one opening to said chamber.

18 Claims, 21 Drawing Sheets

(51) Int. Cl.
*E04G 21/14* (2006.01)
*E04H 1/00* (2006.01)

(56) References Cited

U.S. PATENT DOCUMENTS

2008/0245013 A1* 10/2008 Carlisle ..... E04B 2/8629 52/436
2010/0325998 A1* 12/2010 Clear ..... E04B 2/24 52/562
2012/0240482 A1* 9/2012 Pitt ..... B66C 1/66 52/745.03
2014/0298745 A1* 10/2014 Rechenmacher ..... E04H 1/005 52/425
2015/0113885 A1* 4/2015 Le Carpentier ..... E04B 1/3505 52/745.02
2018/0058060 A1* 3/2018 Anderson ..... E04B 1/34861
2018/0347175 A1* 12/2018 Anderson ..... E04B 1/3483
2019/0330838 A1* 10/2019 Bowron ..... E04B 1/34326
2020/0208395 A1* 7/2020 Hall ..... E04B 1/19
2021/0277649 A1* 9/2021 Bowron ..... E04B 1/2403
2022/0251829 A1* 8/2022 Pospisil ..... B32B 13/04
2022/0412072 A1* 12/2022 Clark ..... E04B 1/34861
2023/0121784 A1* 4/2023 Del Rio ..... E04B 1/3483 52/215

FOREIGN PATENT DOCUMENTS

CN 106592755 A 4/2017
GB 2539948 A * 1/2017 ..... B65D 21/0201
JP H03217532 A 9/1991
KR 20190089971 A * 7/2019
WO 0036238 A1 6/2000
WO 2017019638 A1 2/2017

OTHER PUBLICATIONS

International Search Report and Written Opinion issued for PCT/GB2019/053378, Dated Feb. 6, 2020, 11 pages.

* cited by examiner

MODULAR STRUCTURE AND CONNECTION METHOD

FIELD OF THE INVENTION

The invention relates to modular structures constructed using modular units. In particular, it relates to modular units and a method of connecting two or more such modular units to construct a modular structure.

BACKGROUND

Modular construction refers to the process of constructing a structure, for example a building, using pre-fabricated modular units. Such a structure may be referred to as a modular structure. The modular units are typically fabricated, and optionally fitted out internally, away from the site at which the structure is intended to be constructed, and then delivered to the site for assembly into the final structure. Each modular unit could constitute one or more rooms forming part of a block of flats or a hotel, for example.

Modular construction has several advantages over conventional construction techniques, for example where buildings are constructed from the ground up, on site. It allows for the time spent on-site in the assembly of a structure to be greatly reduced, since much of the work has been done in advance before the modular units are delivered to the construction site and, once the units have been delivered, they can be rapidly assembled into the final structure. Modular units can be manufactured in an environment that is more controlled than a typical building site, so it is practical to manufacture modular units to finer tolerances than are usually achieved by traditional on-site techniques. However, conventional modular construction techniques suffer from a number of limitations.

Modular units are typically joined to one another (i.e. assembled), by bolts. This can require access to specific parts of the exteriors and interiors of the individual modular units in order to assemble them together, but this can be difficult in practice since the presence of adjacent units or other parts of the structure can obstruct access to the points at which the bolts are fastened. Moreover, it is often necessary to leave at least some of the external cladding that typically covers the exterior surface of the modular units, and hence the completed modular structure, off of the units until the process of bolting them together is complete in order to provide the required access for assembly. This prolongs the process of assembling the modular structure since the cladding can only be fixed to the modular units after they have been assembled and fastened together, and therefore requires "post processing" of the modular units once assembled.

A further concern with modular construction is that, in order for a modular structure to have a given amount of interior floor space, a modular structure will typically occupy a greater "footprint" (i.e. the area of the ground covered by the structure) than a building constructed by traditional techniques. This is because each modular unit has its own external wall (or walls), and assembling two such modular units adjacent one another results in the interior spaces of the units (which could be intended to form, for example, rooms in a residential building) being separated by a distance at least twice the thickness of the walls of the two units. In other words, the thickness of adjacent walls of two modular units, when assembled together, is typically greater than the thickness of a corresponding wall in a conventional structure. Similarly, the interior spaces of two modular units stacked one atop the other will be separated by a distance corresponding to the combined thickness of the upper surface (e.g. a ceiling) of the lower unit and the lower surface (e.g. a floor) of the upper unit.

There is therefore a need for an improved system and method of assembling modular construction units, which will enable the external walls of the modular units to be thinner whilst maintaining the required strength in the modular construction, thereby to allow modular structures formed of modular units to be constructed on a given development site with substantially the same interior floor space that a conventional structure would provide.

SUMMARY OF THE INVENTION

Described herein is a modular unit for constructing a modular structure, comprising: a structural frame including: at least one upper beam; at least one lower beam; and at least one column extending between said upper and lower beams and connected therebetween; wherein at least one of said upper or lower beams is arranged to define at least one chamber for receiving a building material therein along at least a portion of its length, said column being connected to said portion of said beam; and wherein part of said beam is removed along said portion of said beam to define at least one opening to said chamber.

Preferably, said beams and columns are hollow, and said column is connected therebetween such that a fluid connection is provided between said beams by said column.

Preferably said at least one opening to said chamber (provided along said beam) comprises a pair of said openings spaced apart such that an opening is provided (in said portion of said beam) on either side of the column.

Preferably, said beam in which said chamber is defined has a substantially rectangular cross-section defined by opposed upper and lower sides, and opposed inner and outer sides, and wherein said opening to said chamber extends partway around the outer side of said beam.

Preferably said beam is the upper beam, and said opening extends around both the upper and outer sides of said upper beam. Additionally, or alternatively, said beam may be the lower beam, such that said opening extends around both the lower and outer sides of said lower beam.

Preferably, at least one of said chamber is defined in each of said upper beam and said lower beam such that said column fluidly connects the chamber in said upper beam with the chamber in said lower beam.

Preferably, at least one element is provided in said chamber for securing thereto a means for lifting the modular unit, preferably wherein said element extends out of the upper side of said beam, and preferably wherein said element is a lifting-eye secured to the upper beam.

Preferably, an aperture (e.g. "fill-hole") is provided in the upper side of said upper beam, said aperture being aligned with the hollow column that is fluidly connected to the upper beam so as to provide a direct fluid pathway into the column for the introduction of building material into the beam(s) and/or column (and hence into their respective chambers, if present) via the aperture.

In preferred embodiments said column may comprise a group of adjacent columns, wherein at least one of said group of columns is hollow. Said column is preferably positioned along a side of the structural frame, wherein said side is intended to be positioned adjacent a corresponding side of the structural frame of another such modular unit. Said column may additionally, or alternatively, be positioned at a corner of the structural frame.

Preferably, a plurality of said columns extend between said upper and lower beam, and a plurality of said chambers are defined in said upper and/or lower beams, each of the plurality of said chambers being arranged in a portion of said beam to which a column is connected, wherein said plurality of columns are spaced apart along at least one side of the structural frame. Thus, the structural frame may comprise a plurality of beams and columns as described herein provided along one or more sides of said structural frame to provide multiple points for joining two adjacent modular units together, as will be described further on.

Also described herein is a modular structure, comprising: a first modular unit and a second modular unit (as described herein), wherein the first and second modular units are connected together by building material contained within adjacently aligned chambers in said at least one upper and/or lower beams of each modular unit, the building material extending between said beams via said openings to said aligned chambers.

Preferably, the first and second modular units are connected together such that said beams, in which said chambers are defined in each of the modular units, are adjacent with said chambers and their openings aligned. Thus, the modular units are connected via the arrangement of beams, columns and openings provided in each structural frame being aligned, as described herein.

Preferably, the first and second modular units are positioned adjacent one another such that beams and columns of the two modular units are adjacently aligned and said chambers in said beams and their openings are adjacently aligned. Thus, the first modular unit may be arranged adjacent the second modular unit such that an opening in an upper beam of the first modular unit is aligned with a respective opening in an upper beam of the second modular unit so as to fluidly connect a hollow chamber in the upper beam of the first modular unit to a respective hollow chamber in the upper beam of the second modular unit.

Preferably, each of said adjacently aligned chambers contains building material, which may be introduced into said chambers, preferably via said aperture. The building material may therefore extend between the adjacent chambers in said beams of the first and second modular units via the aligned openings in said beams so as to connect the first and second modular units, e.g. once the building material hardens. One or more reinforcing members (e.g. metal rods, links, or similar, preferably steel) may be encased within the building material. The building material is preferably concrete, in a form in which it is able to flow until it hardens.

Said chambers may be defined in the upper beam of each modular unit. Additionally, or alternatively, said chambers are defined in the lower beam of each modular unit.

The modular structure may further comprise a third modular unit arranged adjacent and above (e.g. on top of) the first modular unit such that an opening in a lower beam of the third modular unit is aligned with the opening in the upper beam of the first modular unit. In this way, a chamber in the lower beam of the third modular unit is fluidly connected with a corresponding chamber of the upper beam of the first modular unit and the hollow chamber of the upper beam of the second modular unit.

The modular structure may further comprise a fourth modular unit arranged adjacent and above (e.g. on top of) the second modular unit and adjacent and beside (e.g. next to) the third modular unit such that an opening of a chamber defined in a lower beam of the fourth modular unit is aligned with both the opening of a corresponding chamber defined in the upper beam of the second modular unit and the opening of a corresponding chamber defined in the lower beam of the third modular unit. In this way, the chamber in the lower beam of the fourth modular unit is fluidly connected with the chambers in the upper beam of the first modular unit, the upper beam of the second modular unit and the lower beam of the third modular unit.

In preferred embodiments, said chambers of the first and second modular units are provided in adjacent upper beams of the first and second modular units, and an element is provided in each of said chambers for securing thereto a means for lifting the respective modular unit, the structure further comprising a reinforcing member provided around both of said elements in the adjacent chambers so as to secure said elements together.

Preferably, each of said adjacently aligned chambers in said adjacent beams contains (e.g. hardened) building material that extends between the adjacent chambers via the aligned openings in said beams so as to connect the first and second modular units.

As will be appreciated, the modular structure may comprise two, three or more such modular units positioned adjacent one another to form a single-storey configuration. Additionally, or alternatively, the modular structure could comprise two, three or more such modular units positioned on top of one another to form a multi-storey configuration.

Furthermore, as noted in relation to the modular units above, each modular unit may have a plurality of columns connecting between upper and lower beams of a structural frame, wherein the respective portions of the upper and lower beam to which the column connects may each have a chamber defined therein for containing building material. Thus, two or more such modular units connected adjacent one another may have multiple adjacently aligned chambers forming connection "nodes", e.g. at the top or bottom of each column, each node comprising adjacent chambers containing building material, such as concrete, which extends between the adjacent chambers and hardens to form a strong connection, preferably containing one or more reinforcing elements at each connection "node".

Also described herein is a method of connecting together at least two such modular to construct a modular structure as described herein, the method comprising: aligning a first and second modular unit such that they are adjacent with said chambers and openings in said beams adjacently aligned; and introducing a building material into said adjacent chambers, wherein the building material extends between the adjacent chambers via said openings to form a connection when the building material hardens.

Also described herein is a method of constructing a modular structure, comprising: aligning a first and second modular unit (e.g. as described herein) such that they are adjacent, with said chambers and openings in said beams aligned; and inserting a building material (e.g. concrete) into said chambers, wherein the building material can flow freely between the adjacent chambers via said openings such that the building material extends between said adjacent chambers, e.g. once hardened.

Any apparatus feature described herein may be provided as a method feature, and vice versa. Moreover, it will be understood that the present invention is described herein purely by way of example, and modifications of detail can be made within the scope of the invention.

Furthermore, it will be understood by the skilled person that particular combinations of the various features described and defined herein may be implemented and/or supplied and/or used independently.

As will be recognised by a skilled person, numerous advantages over the prior art are provided by the inventive concepts disclosed herein.

LIST OF FIGURES

An embodiment of the present invention will now be described, by way of example only, with reference to the accompanying drawings, in which.

DETAILED DESCRIPTION

Figure 1:
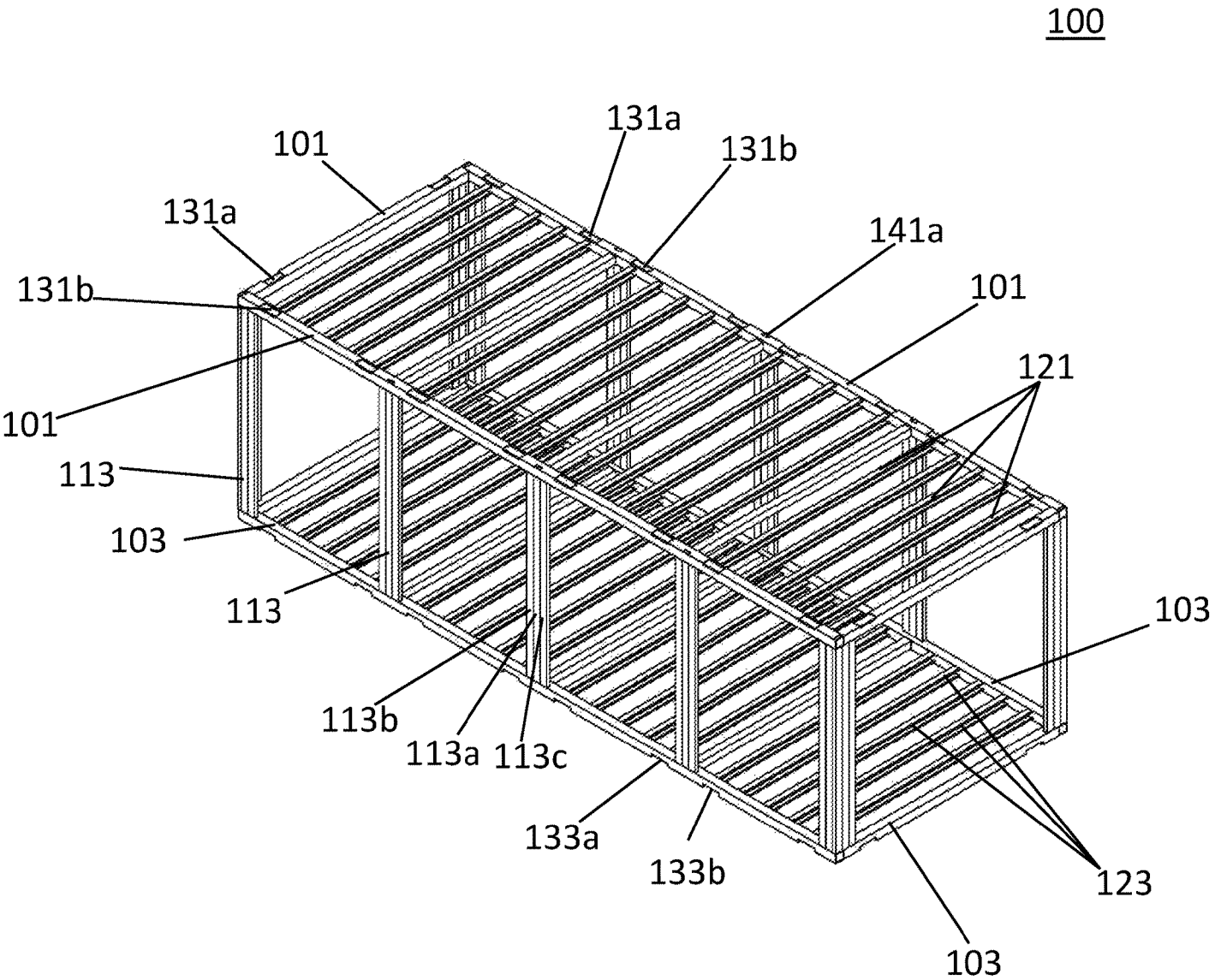
FIG. 1 shows the structural frame of a modular unit.

In the following description and accompanying drawings, corresponding features of separate modular units may be identified using corresponding reference numerals. For clarity, not all of the features are labelled in every figure, though any unlabelled features may of course be cross-referenced against the corresponding figures in which they are shown labelled.

FIG. 1 shows a modular unit 100 suitable for use in constructing a modular building. The modular unit 100 is a simplified representation that illustrates only its structural frame, which is required to describe the present invention. As such, the terms "modular unit" and "structural frame" may be used interchangeably herein. In practice, the exterior walls of the modular unit 100 will typically be covered in a cladding to enclose the interior space defined inside the structural frame.

The modular unit 100 comprises a plurality of upper beams 101, lower beams 103 and columns 113 arranged to define the shape of the structural frame. The upper beams 101 and the lower beams 103 are arranged horizontally and in parallel. The columns 113 extend vertically between the upper beams 101 and the lower beams 103, and are spaced apart around the exterior of the structural frame to provide structure for the external walls of the modular unit 100.

At each location around the structural frame of the modular unit 100 where a column 113 is required there may be provided a plurality of columns 113 arranged in groups. For example, a group of columns 113 may include a middle column 113*a* with a column 113*b*, 113*c* arranged on either side of it. A similar group of columns 113 may lie in the same plane as this first group of columns 113 to define an exterior wall of the modular unit 100, as mentioned above. A corner of the structural frame may be provided by a group of five columns 113 that includes a middle column 113*a*, with two columns 113*b*, 113*c* arranged on either side of it, for example.

A pair of openings 131*a*, 131*b* is provided in the upper beam 101, the openings 131 being spaced apart on either side of the columns 113. The openings 131 each extend across the upper side 101*a* and around the edge of the beam 101 to a point part-way down the outer side 101*b* of the beam 101. An upper fill hole (e.g. "aperture") 141*a* is also provided in the upper side 101*a* of the upper beam 101 between the two openings 131.

A plurality of cross-members 121, 123 are provided in the structural frame for the attachment or support of floor and/or ceiling members thereto. A plurality of upper cross-members 121 extend between parallel pairs of upper beams 101. Similarly, a plurality of lower cross-members 123 extend between parallel pairs of lower beams 103. The beams 101, 103, columns 113 and cross-members 121 of the first modular unit 100 define an interior space for use as one or more rooms in a residential building or hotel, for example.

The modular unit 100 shown in FIG. 1 has a rectangular plan (i.e. is rectangular in shape as viewed from above or below). Modular units having other shapes can, however, be provided by the same principles of construction described herein. A modular unit could have a plan in the shape of a square or rhombus, for example.

Figure 2:
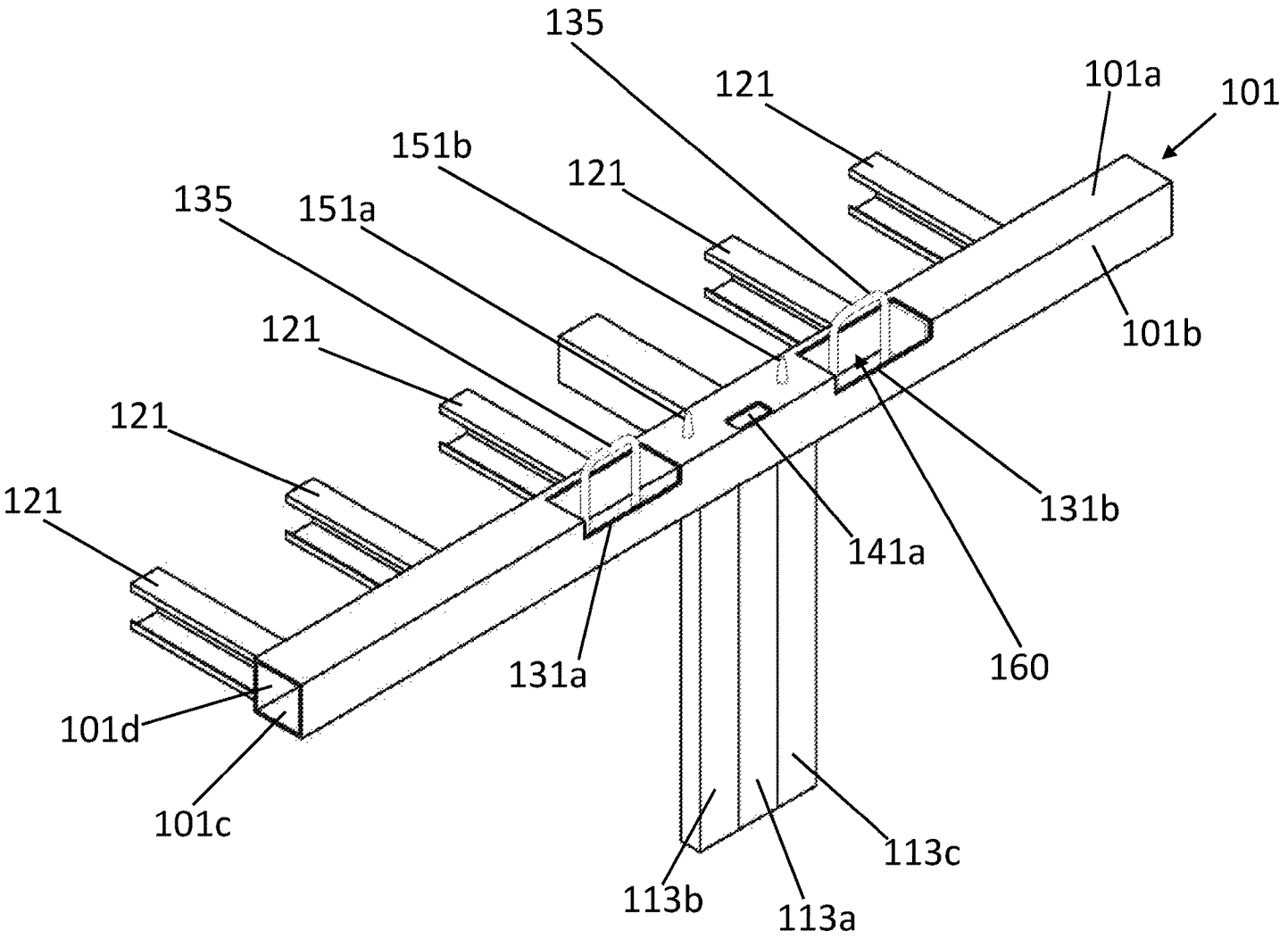
FIG. 2 shows an arrangement of an upper beam and columns of the modular unit shown in FIG. 1 according to the present invention.

FIG. 2 is a close-up view showing an arrangement where an upper beam 101 is connected with (a group of) columns 113 as part of the structural frame of a modular unit 100. The upper beam 101 has a rectangular (e.g. square) cross-section and a hollow interior defined by an upper side 101*a* and an underside 101*c*, an outer side 101*b* and an inner side 101*d* of the upper beam 101, wherein adjacent sides of the beam 101 are arranged perpendicular such that the upper and lower sides 101*a*, 101*c* are opposed, and the outer and inner sides 101*b*, 101*d* are opposed. While in this example the sides 101*a*, 101*b*, 101*c*, 101*d* of the beam 101 are arranged such that the beam has a substantially square cross-section, the beam could be formed of a different shape, though the outer side 101*b* will preferably be a flat surface, and will most preferably be oriented vertically in use.

Although not shown in detail in FIG. 2, the lower beam 103 has a construction similar to the upper beam 101, such that the lower beam 103 essentially mirrors the upper beam 101, with corresponding pairs of openings 133*a*, 133*b* being provided on either side of the columns 113, as can be seen in FIG. 1. The lower beam 103 may therefore be imagined as the upper beam 101 rotated through 180 degrees, with the column 113 connecting therebetween.

Thus, although it is not visible in FIG. 2, a lower fill hole 141*b* is provided on the underside 101*c* of the upper beam 101, the lower fill hole 141*b* being positioned directly over the middle column 113*a* to provide a fluid path to said column 113*a*. The upper fill hole 141*a* is, ideally, positioned directly above the lower fill hole 141*b*, and thereby directly above the middle column 113*a* to provide a direct fluid path from above the upper beam 101 into the middle column 113*a*.

In this example two openings 131*a*, 131*b* are formed either side of the column 113*a*. However, the portion of the beam 101 in which the chamber 160 is located could alternatively have only one opening 131 (which would preferably be arranged directly above the column 113*a*), or a plurality of openings 131, e.g. one opening 131 arranged directly above the column 113*a* and two additional openings 131 arranged either side of the column 113*a*. The openings 131 are preferably rectangular, though they could be shaped differently, for example having rounded edges.

An interior portion of the upper beam 101 that includes the one or more columns 113 is partitioned by blanking plates 161. The blanking plates 161 are installed (e.g. welded) into the interior of the upper beam 101 at locations spaced from either side of the columns 113. The interior portion of the upper beam 101 that is formed by the blanking plates thereby defines a chamber 160 (i.e. a defined space) within the upper beam 101. The blanking plates 161 are positioned within the interior of the upper beam 101 at the far (i.e. distal, relative to the columns 113) edges of the openings 131, such that the openings 131 remain within the chamber 160. As such, the fill holes 141*a*, 141*b* also remain within the chamber 160.

As with the beams 101, 103, one or more of each of the columns 113 connecting therebetween also has a hollow interior. As noted above, the middle column 113*a* is connected to the upper beam 101 such that the hollow interiors of the column 113*a* and the beam 101 are fluidly connected, via the fill holes 141*a*, 141*b*. In this example, the columns 113*b*, 113*c* adjacent the middle column 113*a* are not fluidly connected to the beams 101, 103. However, in other embodiments, one or both of the adjacent columns 113*b*, 113*c* could be fluidly connected to the beam instead of, or in addition to, the column 113*a*. The adjacent columns 113*b*, 113*c* provide additional strength and rigidity to the modular unit 100.

Lifting eyes 135 (e.g. loops or brackets) are provided for lifting the structure, by a crane for example. The lifting eyes 135 are attached, preferably welded, to the beam 101. The lifting eyes 135 are, ideally, disposed within the openings 131 and extend vertically upwards out of the openings 131. The lifting eyes 135 can be used to lift the modular unit 100, for example when transporting the modular unit 100 or when positioning it during the construction of a modular building. The lifting eyes 135 are further utilised during the assembly of two such modular units 100 to form a modular structure, as will be described further on.

Locating pins 151*a*, 151*b* are disposed on the upper side 101*a* of the upper beam 101. The locating pins 151*a*, 151*b* are arranged to be received by corresponding locating holes formed on the underside 103*c* of a lower beam 103 of another such modular unit (not shown) when stacked on top of said modular unit 100 to form a multi-storey modular structure.

As mentioned before, a plurality of cross-members 121 extend between opposed upper beams 101 to provide rigidity and strength to the modular unit 100, as shown in FIG. 2.

Figure 3:
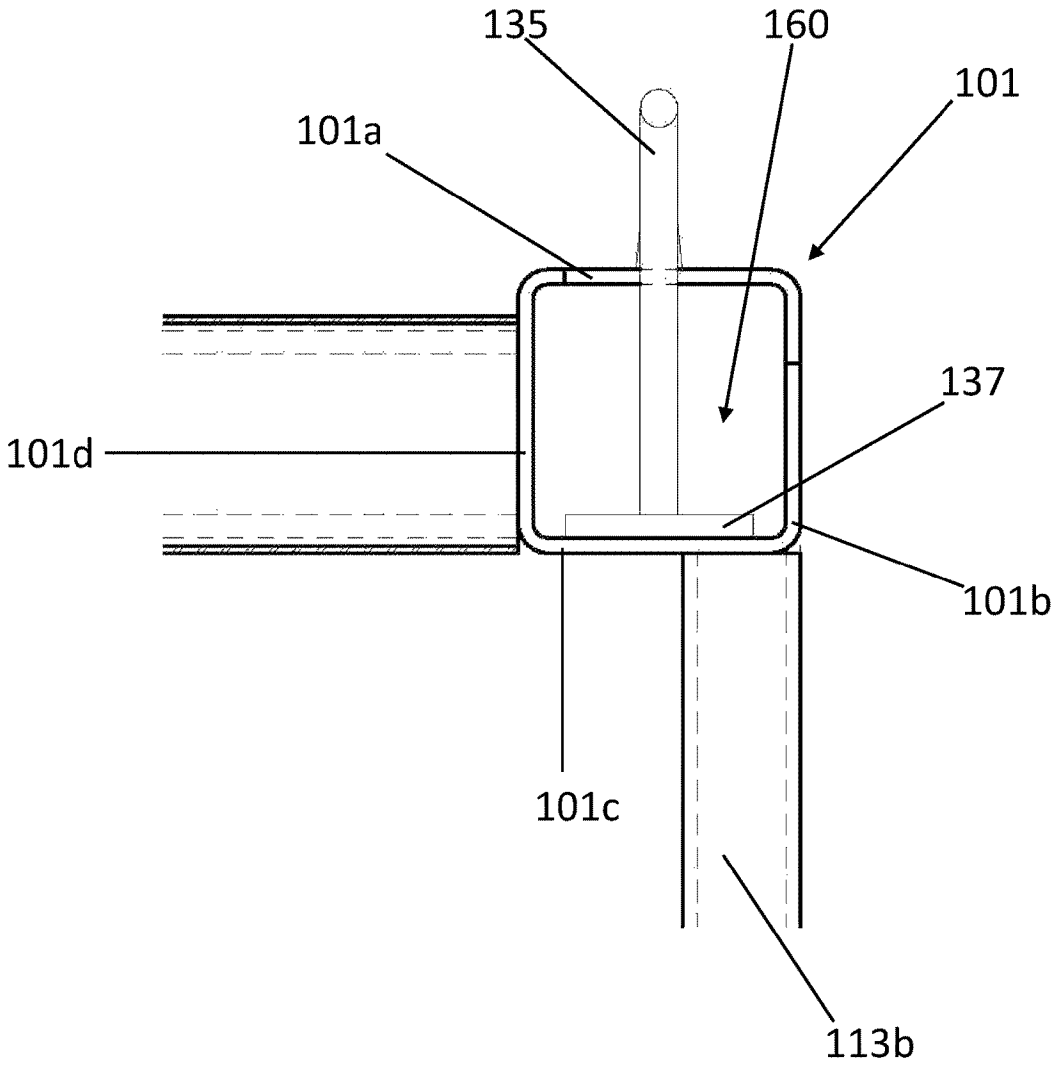
FIG. 3 shows a cross-sectional view the arrangement shown in FIG. 2 taken through the beam.

FIG. 3 is a cross-sectional view of the arrangement of the upper beam 101 and columns 113 shown in FIG. 2, within the chamber 160. The lifting eyes 135 each comprise a base portion 137 that is attached (preferably welded) inside the chamber 160 to the underside 101*c* of the beam 101. As can be seen, the lifting eyes 135 extend vertically upwards out of the chamber 160 and away from the upper side 101*a* of the upper beam 101 to allow a crane hook to be attached, for example.

Figure 4A:
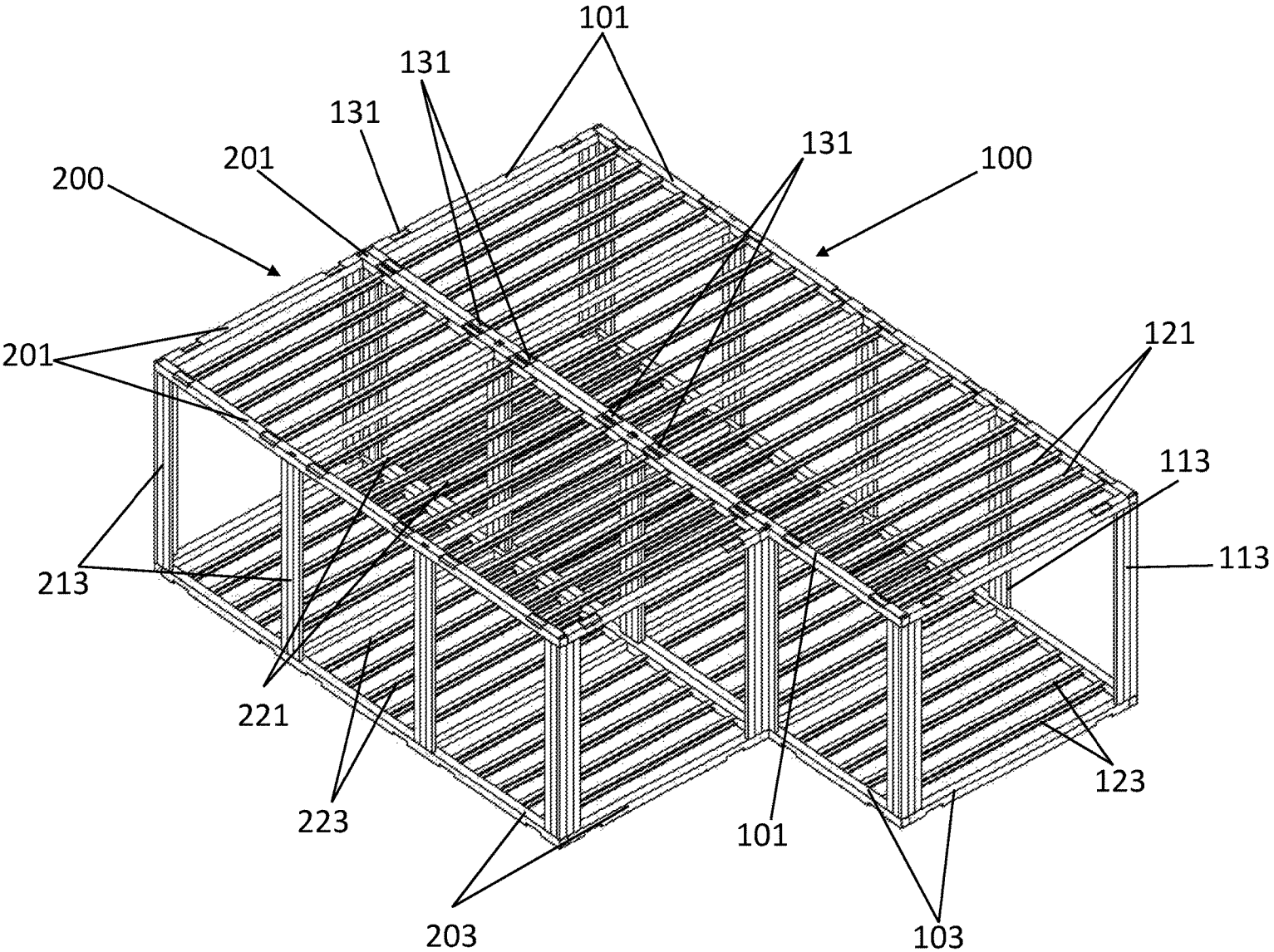
FIG. 4A shows a modular unit of the type shown in FIG. 1 arranged side-by-side with an additional modular unit.

FIG. 4A shows the (e.g. first) modular unit 100 positioned against (e.g. adjacent) another such (e.g. second) modular unit 200, with both of the modular units 100, 200 represented in the form of a structural frame. As mentioned above, the structural frame of the second modular unit 200 has a similar construction to the first modular unit 100, and therefore includes a plurality of horizontal upper and lower beams 201, 203, with a plurality of spaced apart (groups of) columns 213 extending therebetween. Openings 231 similar to the openings 131 of the upper beam 101 of the first modular unit 100 are formed in the upper beam 201 of the second modular unit 200, which are visible in FIG. 4A.

When the two modular units 100, 200 are positioned together side-by-side, adjacent one another, as shown in FIG. 4A, their respective upper beams 101, 201 are thereby in contact with, and lie parallel to, one another. Similarly, their respective lower beams 103, 203 are in contact with, and lie parallel to, one another. The surfaces of the outer sides 101*b*, 201*b*, 103*b*, 203*b* of the beams 101, 201; 103, 203 at the interface between the modular units 100, 200 are therefore arranged to be substantially flat so as to enable them to lie flush against one another.

Figure 4B:
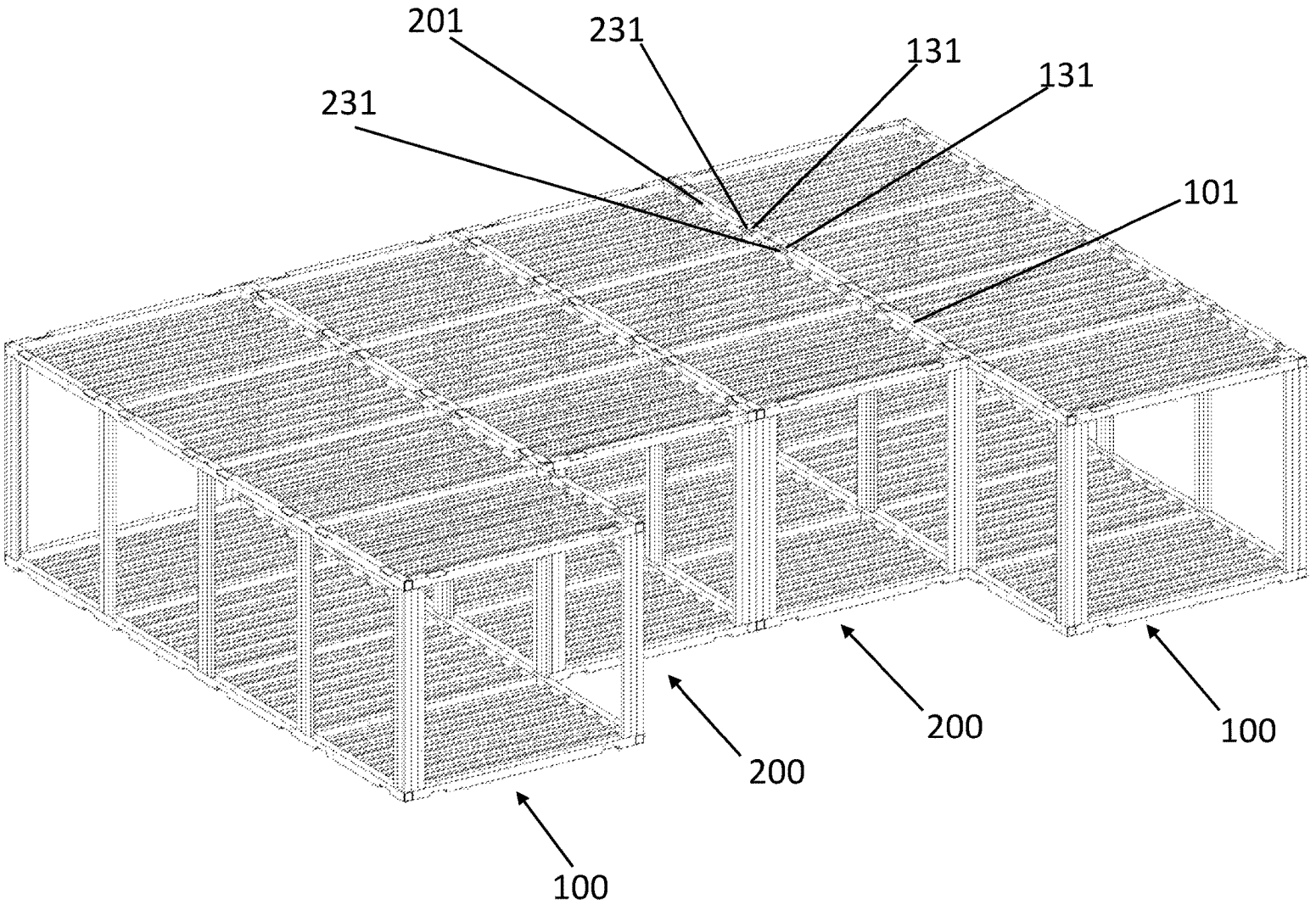
FIG. 4B shows the modular units of FIG. 4A adjacent two additional modular units.

FIG. 4B shows the first and second modular units 100, 200 arranged adjacent two additional such modular units 100, 200. The four modular units 100, 200 could be connected (by a method as described later) in this configuration to form, for example, a single-storey building or one story of a multi-storey building.

In one embodiment, one or more modular units 100, 200 (e.g. as described herein above with reference to FIGS. 4A and 4B) may be used to construct a single-storey building. For example, a foundation of a single-storey building could be provided with projecting members similar to the lifting eyes 135, 235. Thus, a modular unit 100 may have openings 133 in the lower beam 103 adapted to receive the projecting members in the foundation, and a suitable building material (e.g. concrete) may then be introduced into the lower beam 103 via a fluidly connected column 113, for example, so as the encase the received projecting members in the building material within a chamber formed in the lower beam 103 (similar to described above), thereby securing the modular unit 100 to the foundation.

As will now be described, additional modular units could also be stacked vertically on the first and second modular units 100, 200 respectively and connected thereto in order to form a part, or the whole, of a modular structure. In its simplest form, a multi-storey building could be formed by stacking a single modular unit (such as the first modular unit 100) with another such modular unit stacked on top of it.

Figure 4C:
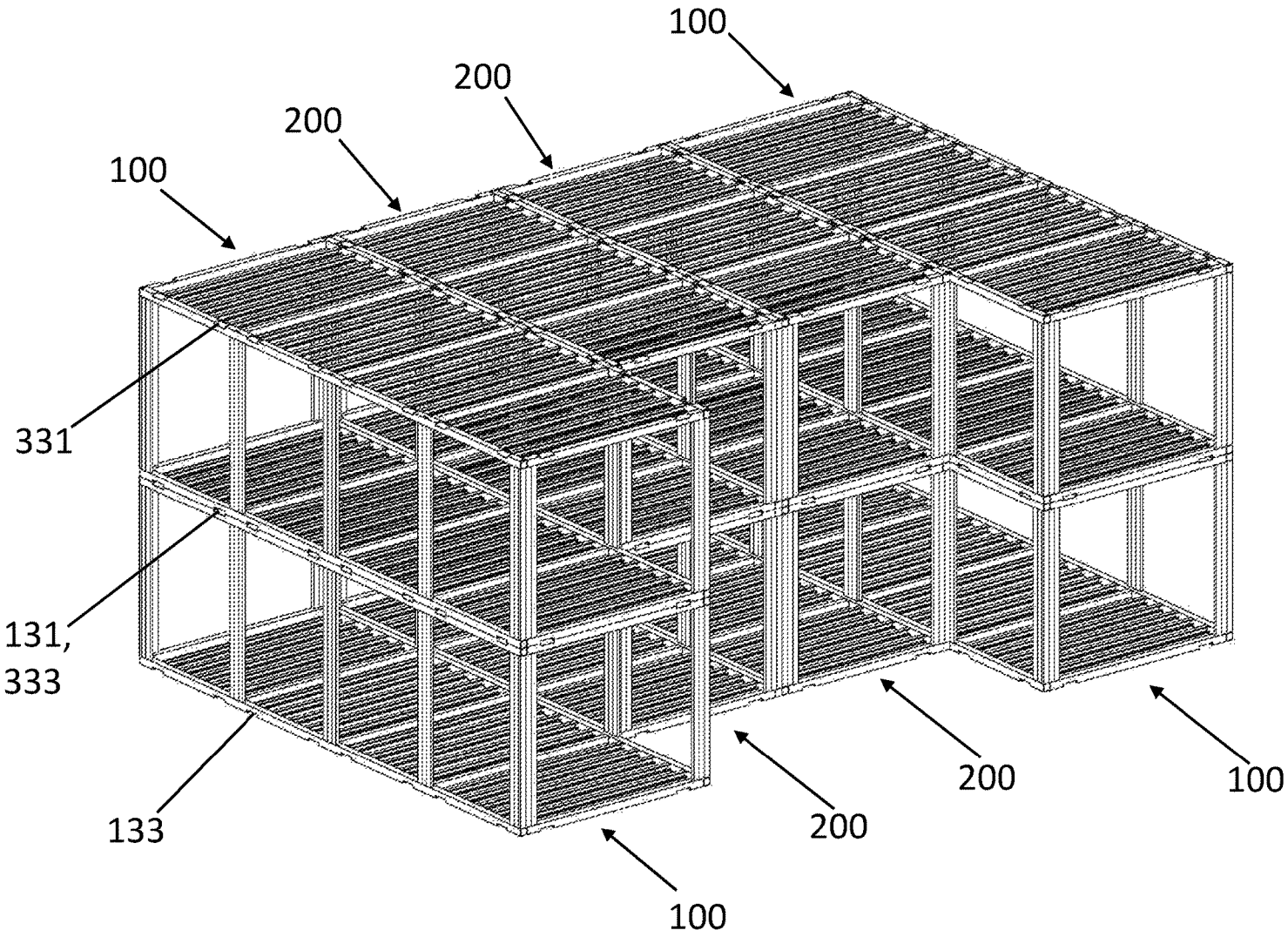
FIG. 4C shows four additional modular units stacked above the four modular units shown in FIG. 4B.

FIG. 4C shows the modular units 100, 200 of FIG. 4B with four additional modular units 100, 200 stacked thereon. The modular units 100, 200 shown in this Figure could be connected (as will be described in detail later) so as to form a two-storey building. The lower modular units could also be connected to a foundation as described above. It will be appreciated that an arbitrary number of additional modular units could be provided adjacent and/or atop those shown in FIG. 4C so as to form a building with additional storeys and/or a different floor plan.

Figure 5:
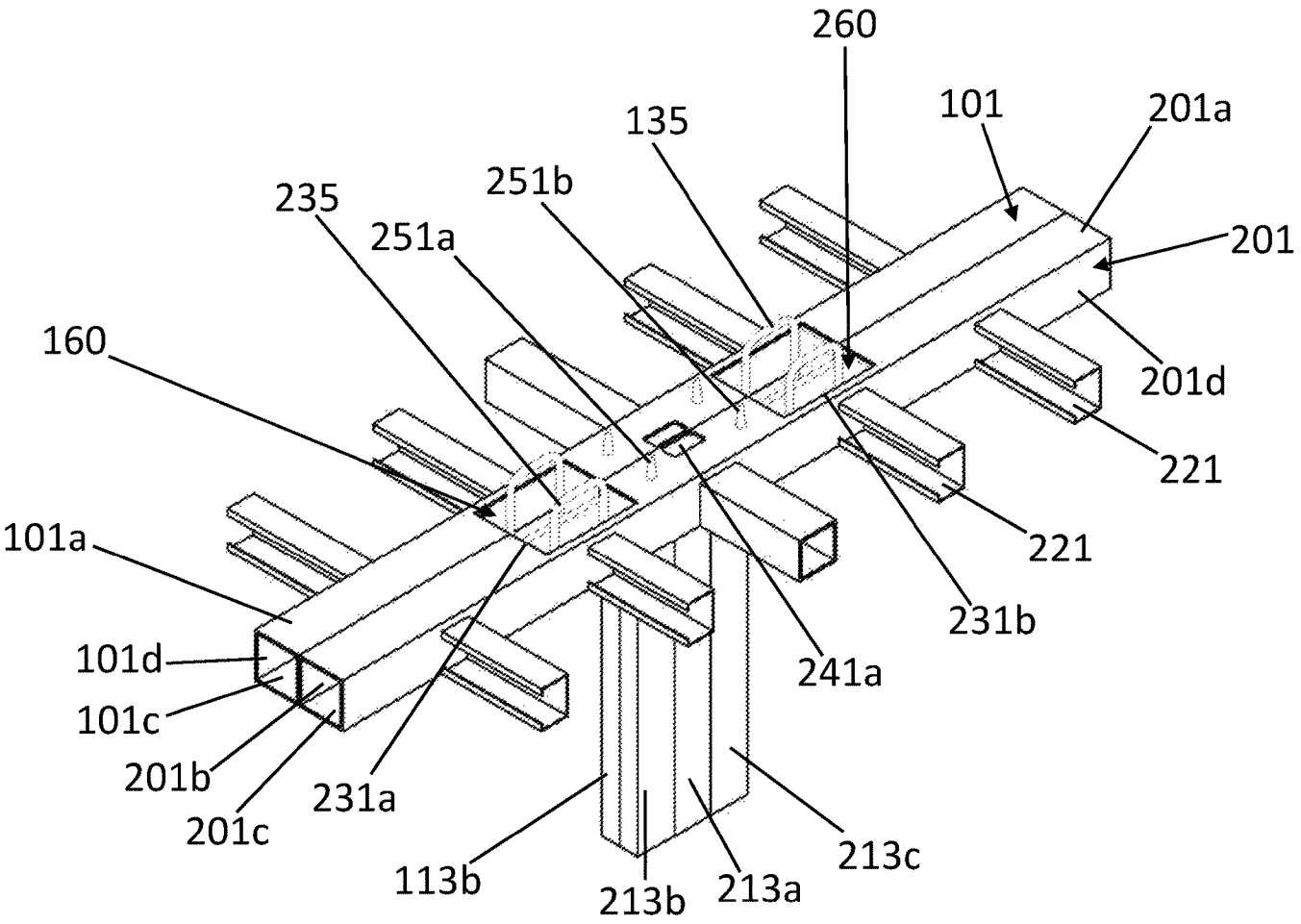
FIG. 5 shows the arrangement of the upper beams and columns of the adjacent modular units shown in FIG. 4A.

FIG. 5 shows an arrangement of the upper beams 101, 201 and columns 113, 213 of the two adjacent modular units 100, 200 shown in FIG. 4A. The second modular unit 200 contains a corresponding set of features to those of the first modular unit 100, as discussed above. The first modular unit 100 has not been labelled in detail in FIG. 5, as its features are clearly labelled in FIG. 2.

With the modular units 100, 200 arranged side-by-side, the pairs of openings 131, 231, which are provided in the upper beams 101, 201 of the respective modular units 100, 200, are aligned together such that the chambers 160, 260 defined within the interior of each upper beam 101, 201 are in fluid communication with one another via the openings 131, 231.

Figure 6:
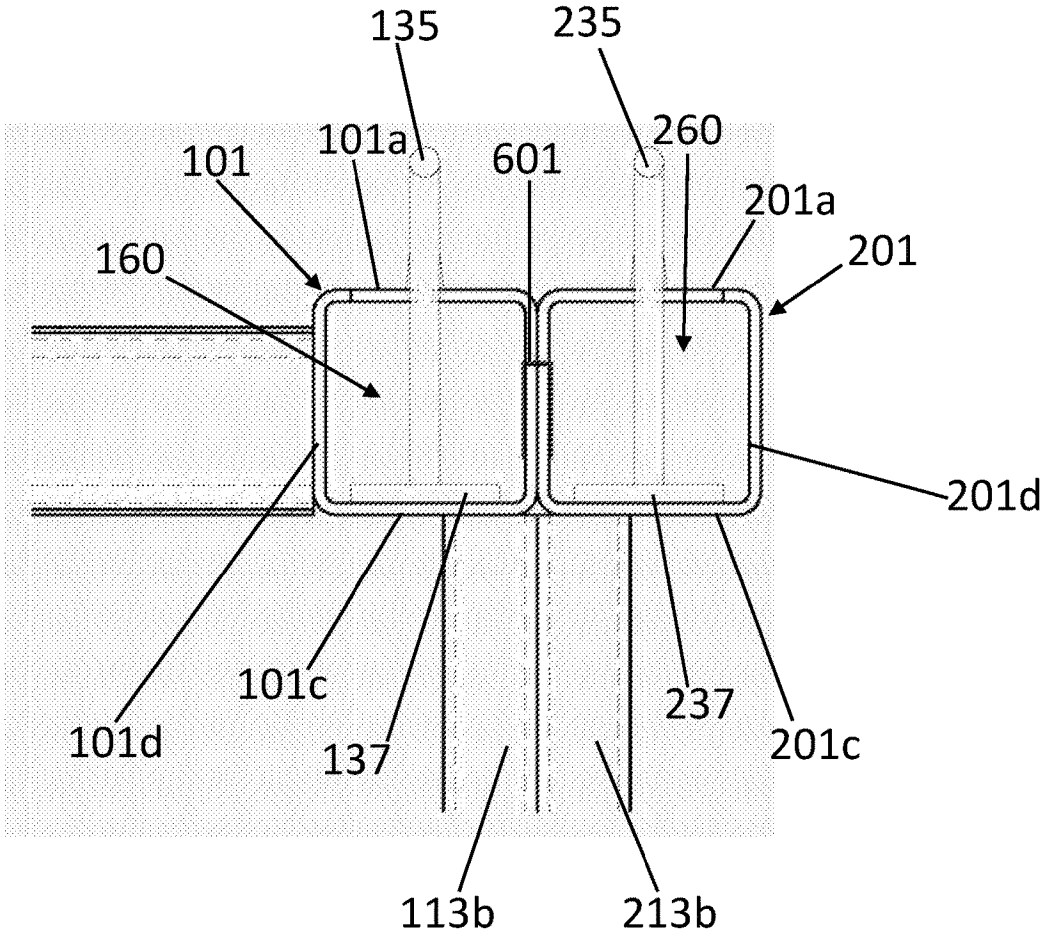
FIG. 6 shows a cross-sectional view of the arrangement shown in FIG. 5 taken through the beams with a coupling element installed.

FIG. 6 shows a cross-sectional view taken perpendicularly through the adjacent upper beams 101, 201 shown in FIG. 5. The cross-section is taken through the chamber 160 at a location between the blanking plate 161 and the lifting-eyes 135, 235. A coupling element 601 in the form of a, preferably steel, "U"-shaped bracket is placed over the lowered portions of the outer sides 101*b*, 201*b* of the adjacent upper beams 101, 201. The lowered portions are of course formed by the openings 131, 231 extending round the outer sides 101*b*, 201*b* of the upper beams 101, 201. The coupling element 601 extends across the interface between the two openings 131, 231 in order to prevent a building material introduced to the chambers 160, 260 (as will be described in detail later) spilling between the adjacent beams 101, 201. A similar coupling element (not shown) could similarly be secured over the outer sides 101*b*, 201*b* of the upper beams 101, 201 at the interface between the openings 131, 231.

Figure 7:
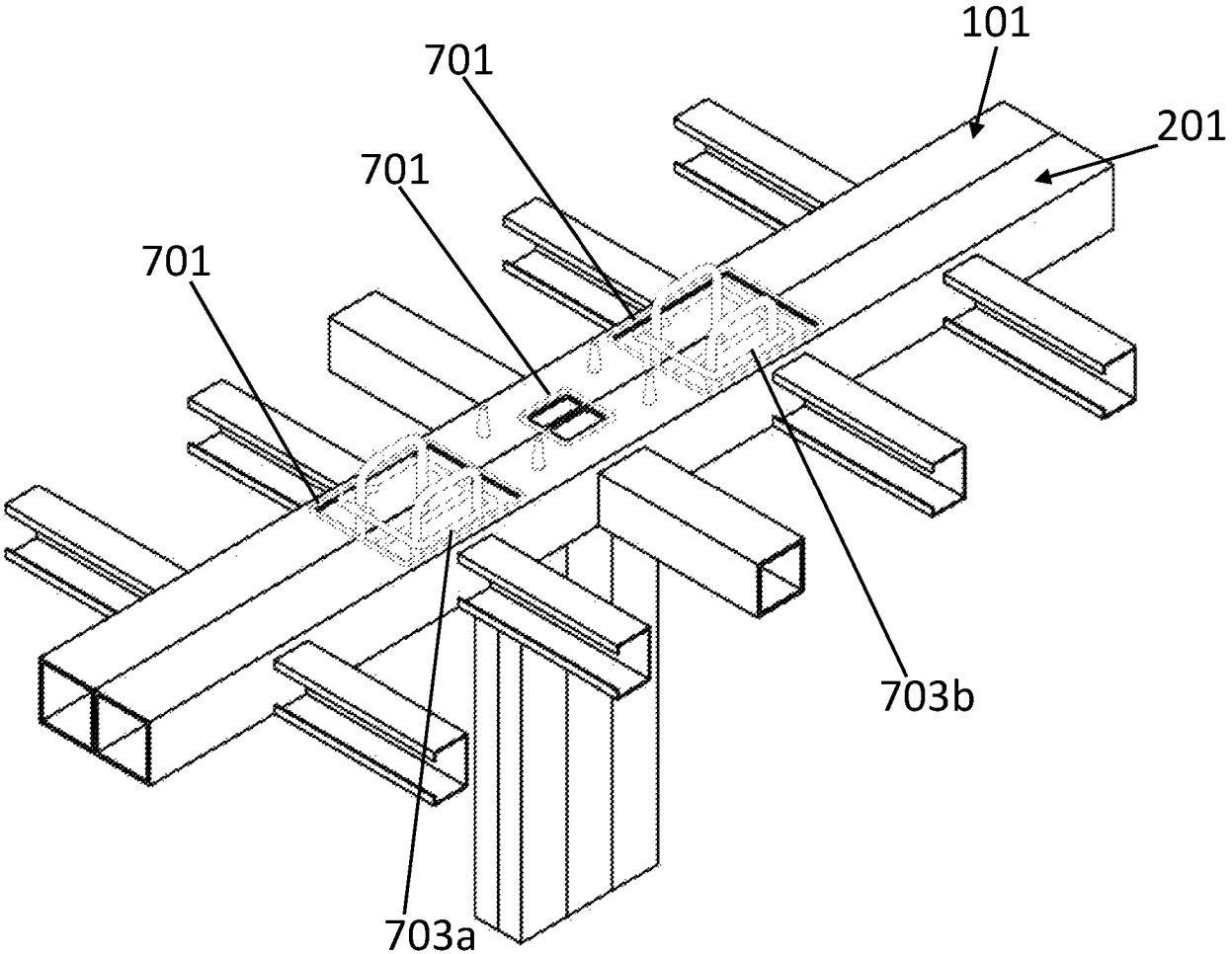
FIG. 7 shows a further view of the arrangement shown in FIG. 5 with reinforcing members installed.

As can be seen in FIG. 7, a reinforcing member 703, in the general form of a ring, is disposed within the combined opening 131, 231 such that it surrounds the two adjacent lifting eyes 135, 235. The reinforcing member 703 rests on the coupling element 601 such that it is below the level of the upper sides 101*a*, 201*a* of the upper beams 101, 201. Similarly, a securing member 703 embraces another pair of adjacent lifting eyes 135, 235. The reinforcing members 703 are ideally made from steel. The reinforcing members 703 assist in coupling the modular units 100, 200 together, and provide further reinforcement when encased in building material, as will be explained later. It may be desirable to provide a plurality of reinforcing members 703 around the lifting eyes 135, 235 in order to provide further reinforcement to the completed modular structure.

Once two adjacent modular units 100, 200 are in position, and preferably coupled as described above, sealant 701 (e.g. mastic sealant), may be applied around the combined openings 131, 231, and also around the respective upper fill holes 141*a*, 241*a* in the upper beams 101, 201, as shown in FIG. 7. As will be discussed later in more detail, the sealant 701 assists in forming a sealed fluid connection around the openings 131, 231 that prevents building material from spilling out of the chambers 160, 260.

To form a robust connection between two adjacent modular units 100, 200 described above, a building material, ideally concrete, is introduced into the interior of the structural frame. In the example shown in FIG. 8, liquid concrete has been introduced into the hollow interior of the beams 101, 201 via the upper fill holes 141*a*, 241*a* in the upper beams 101, 201. The concrete fills the columns 113*a*, 213*a* that are fluidly connected to the upper beams 101, 201 before spilling out to fill the chambers 160, 260 once the columns 113*a*, 213*a* are full.

Although not shown in the figures, the lower beams 103, 203 of the modular units have similar, corresponding chambers formed around each of the (groups of) columns 113, which are fluidly connected to at least the middle column 113*a*, which therefore provides a fluid conduit between the chambers 160, 260 in the upper and lower beams 101, 103 of a modular unit. Thus, concrete introduced into the column 113 via the upper fill hole 141*a* in the upper beam 101 first fills the lower chamber in the lower beam 103, and then the column 113, before filling the chamber 160 in the upper beam 101.

As mentioned, the lower chambers formed in the lower beams 103 are, preferably, provided with similar openings 133, which correspond in size and position, to the openings 131 provided on the upper beams 101. However, the openings 133 on the lower beams 103 are provided in the underside 103*c* of the lower beams 103. One way to visualise this is to imagine the modular units turned upside down. This arrangement can also be seen on the third modular unit 300, illustrated in FIG. 13, for example. The openings in the lower beam 103 will not have lifting eyes disposed therein, however.

Ideally the building material is introduced to the lower chambers in the lower beams 103 via hollow insertion tubes (not shown) that are inserted into each of the columns 113*a*, 213*a* via the upper fill holes 141*a*, 241*a*. The building material can be poured into the hollow insertion tubes, which would then be slowly withdrawn upwards and out of the columns 113*a*, 213*a* so as to release building material into the lower beams 103 and the columns 113*a*, 213*a*. This approach has been found to reduce the formation of voids in the building material inside the beams 101, 103, 201, 203 and columns 113*a*, 213*a* and (in particular when the building material is concrete) reduce the separation of aggregate from the building material.

The concrete (or other suitable building material) eventually hardens, thus forming a continuous block 800 of solid concrete that extends between the combined chambers 160, 260 of the upper beams 101, 201 of adjacent modular units 100, 200 and provides a resilient connection between them. The concrete further hardens around the, preferably steel, reinforcing member 703, described above, which reinforces the strength of the concrete. As the concrete hardens in the columns 113, it further provides rigidity and strength to the structural frame of the modular units.

Concrete in the lower chambers provided in the lower beams 103, 203 of a modular unit that is placed directly onto the ground or foundation of the structure to be assembled will be prevented from leaking out of the lower chambers via the openings in the lower beams 103, 203 by way of the close contact with the ground (or foundation), and will harden accordingly. Alternatively, such openings may not be provided in the lower beams of a "base" modular unit, or may otherwise be sealed off with a blanking plate, for example, that is welded to the lower beam.

In this way, no external fixings (e.g. bolts) are required to secure the modular units 100, 200 together, because the building material can be inserted into the beams and columns of each modular unit 100, 200 via the upper fill holes 141*a*, 241*a* located in the upper beams 101, 201 of the upper modular units 100, 200. Thus, the modular units do not require finishing (e.g. exterior cladding to be added or fixed) once the modular units are positioned and secured together.

Figure 9:
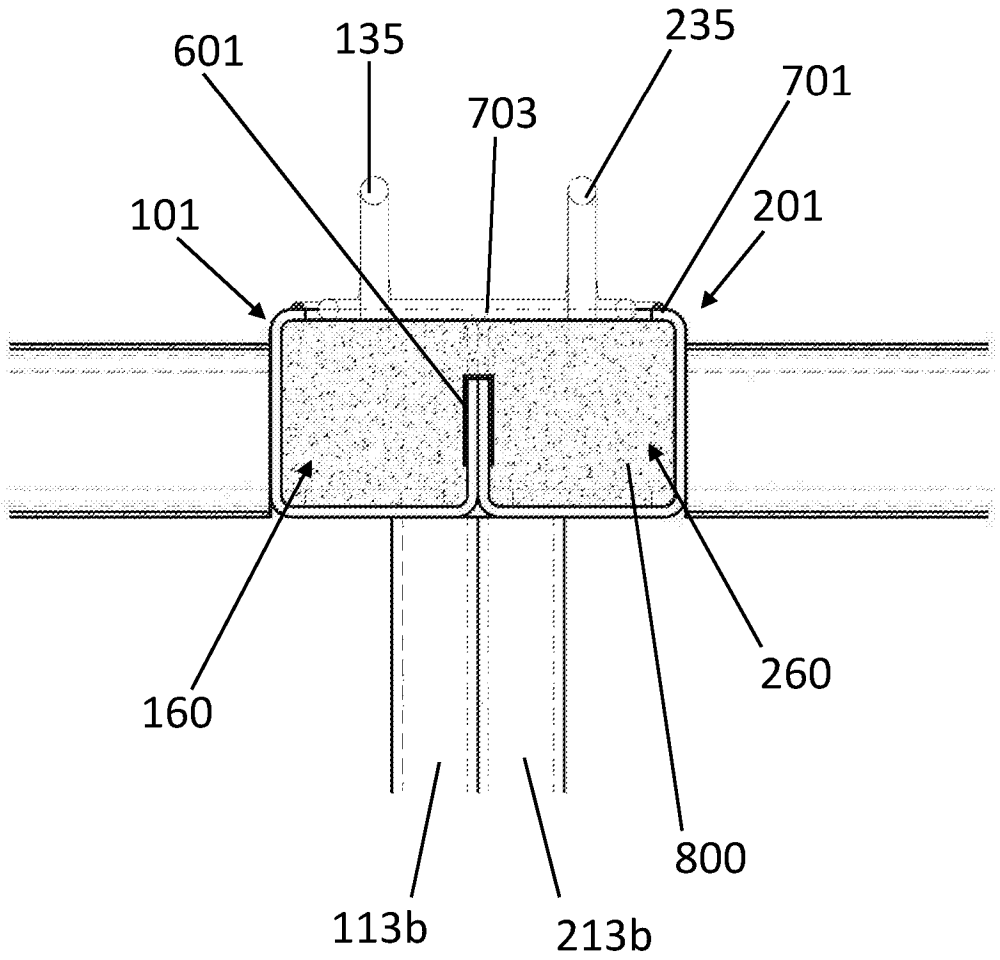
FIG. 9 shows a cross-sectional view of the arrangement shown in FIG. 8 taken through the beams showing the building material contained within with a further reinforcing member installed.

FIG. 9 shows a cross-sectional view of a connection "node" formed by the adjacent upper beams 101, 201, and as such clearly illustrates how the hardened concrete forms a block 800 that extends between the chambers 160, 260 across the interface between the openings 131, 231. The coupling element 601 helps to prevent the concrete leaking past the lowered sides 101*b*, 201*b* of the openings 131, 231.

Figure 10:
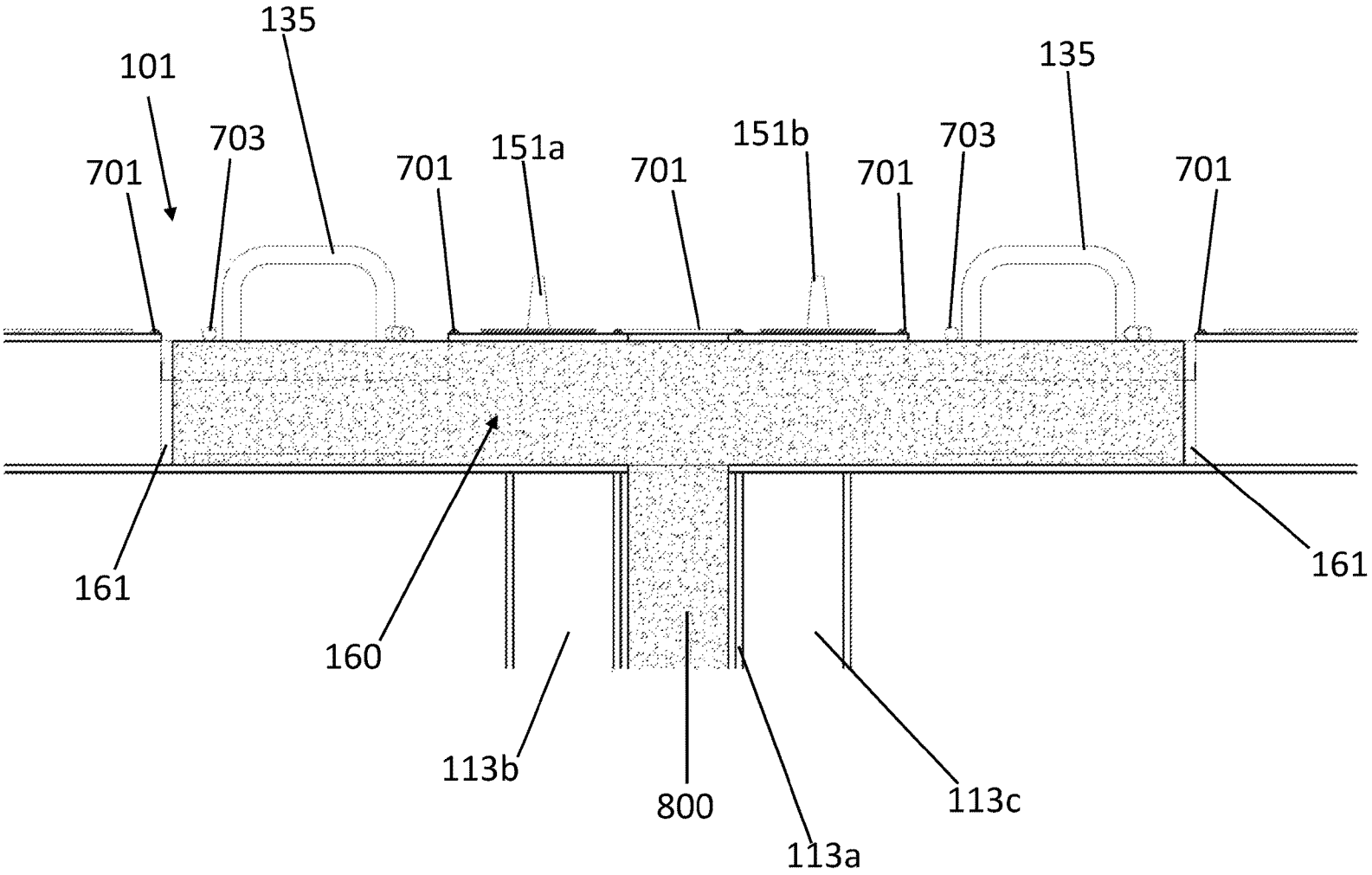
FIG. 10 shows a cross-sectional view of the arrangement shown in FIG. 8, from an angle perpendicular to the view shown in FIG. 9, taken along a plane that passes through one of the columns.

FIG. 10 shows a cross-sectional view of the first modular unit 100 taken in a plane that passes through the columns 113 of a modular unit 100, which plane is generally perpendicular to the plane of the cross-section of the connection "node" shown in FIG. 9. The hardened concrete block 800 can be seen to extend from the chamber 160 of the beam 101 into the interior of the columns 113*a* via the lower fill hole 141*b* formed in the underside 101*c* of the upper beam 101, which fill hole 141*b* is located directly above the middle column 113*a*, at the point at which the column 113 connects to the upper beam 101.

As mentioned previously, it is not essential that the beams 101, 201 are provided with exactly two openings 113, 213, nor is it essential that the openings 113, 213 are offset along the beams 101, 201 from columns 113*a*, 213*a* of the respective modular units 100, 200. However, the arrangement shown in this example is preferable since the upper side 101*a* of the beam 101 will resist movement of the block 800 along the direction parallel to the columns 113*a*, 213*a*. This improves the rigidity of the connection between the connected modular units 100, 200, 300, 400. An advantage of the openings 113, 213 being offset along the beam with respect to the columns 113*a*, 213*a* is that it allows features such as the lifting eyes 135 to be arranged away from the fill holes 141*a*, 241*a*, which improves the ease with which a building material can be introduced to the interiors of the column 113*a* and the upper and lower beams 101, 103.

Figure 8:
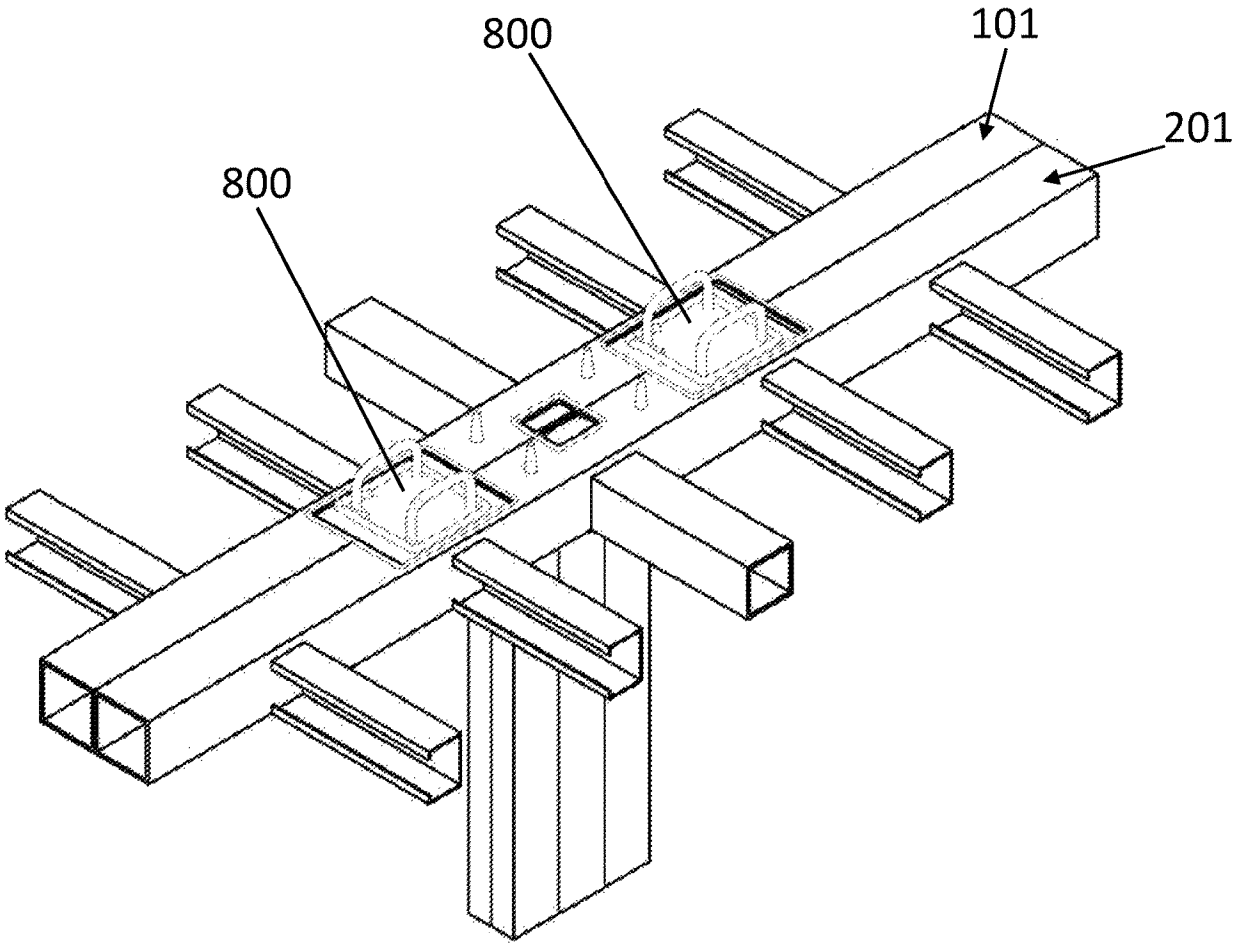
FIG. 8 shows the arrangement shown in FIG. 5 with building material contained within the beams.
Figure 11:
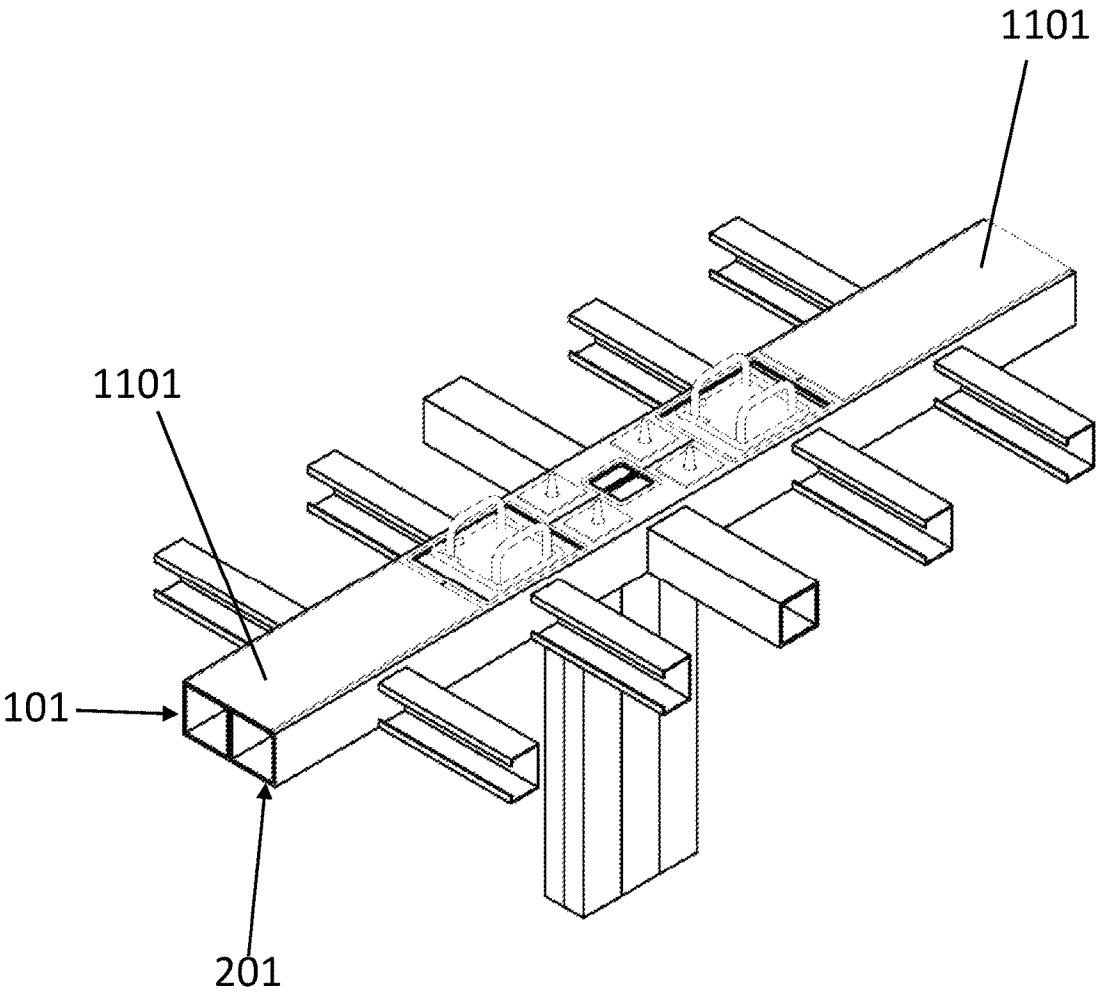
FIG. 11 shows the arrangement shown in FIG. 8 with levelling shims and cushioning material provided on the upper beams.

FIG. 11 shows the modular units 100, 200 connected as illustrated in FIG. 8. Layers of resilient material 1101 are disposed on the upper sides 101*a*, 201*a* of the upper beams 101, 201 where the surfaces of the upper sides 101*a*, 201*a* the upper beams 101, 201 are exposed. The layers of resilient material 1101 (e.g. a fire-resistant textile material) are placed on the upper beams 101, 201 of the connected modular units 100, 200 so as to prepare the structure formed by the connected modular units 100, 200 to receive a third such modular unit 300 and, optionally, a fourth such modular unit 400 (as described later, and shown in FIGS. 13 to 19) to be stacked on top of the first and second modular units 100, 200, respectively. The layers of resilient material 1101 contact with the undersides 303*c*, 403*c* of the lower beams 303, 403 of further such modular units 300, 400 stacked thereon in order to distribute the load caused by the weight of the additional units evenly across the beams 101, 201 and prevent intermittent contact of the adjacent metal beams. Such intermittent contact is particularly likely to occur during the assembly of a modular structure (and, once assembled, in the course of its day-to-day use) as the beams 101, 201 may deflect as a result of the varying stresses that they experience throughout this process. The resilient material 1101 is therefore provided to protect the upper beams 101, 201 against the impact of another modular unit 300, 400 that collides with the upper beams 101, 201 as it is lowered onto the first or second modular unit 100, 200. The resilient material 1101 may incorporate a non-flammable, or preferably fire-retardant, material that provides the further benefit of improving the fire-resistant properties of a modular structure constructed using modular units 100 of the kind described herein.

Four shims 153 are also shown provided on the upper side 101*a*, 201*a* of the upper beams 101, 201 in FIG. 8, proximate to the columns 113, 213. Each shim 153 has a through-hole formed therein that allows one or more such shims 153 to be placed over each locating pin 151, 251, as applicable. The shims 153 can be used to compensate for imperfect levelling of the modular units 100, 200, 300, 400. For example, it could be determined, after the formation of the concrete block 800 in the process described above, that the beam 101 onto which the third modular unit 300 is to be stacked is not level. A survey is performed after each layer (or "storey") of module units has been placed, with laser levelling techniques used to obtain very accurate measurements relating to how level a unit is. An appropriate number of shims 153 are then placed on the locating pins 151 of the first modular unit 100 to ensure that the next layer (or storey) of modular units are placed level. The use of shims 153 in this way allows for errors in the levelling of modular units in a modular structure to be corrected and thus mitigate the detrimental effect of such errors (and in particular the effect of an accumulation of such errors) on the completed modular structure.

Figure 12:
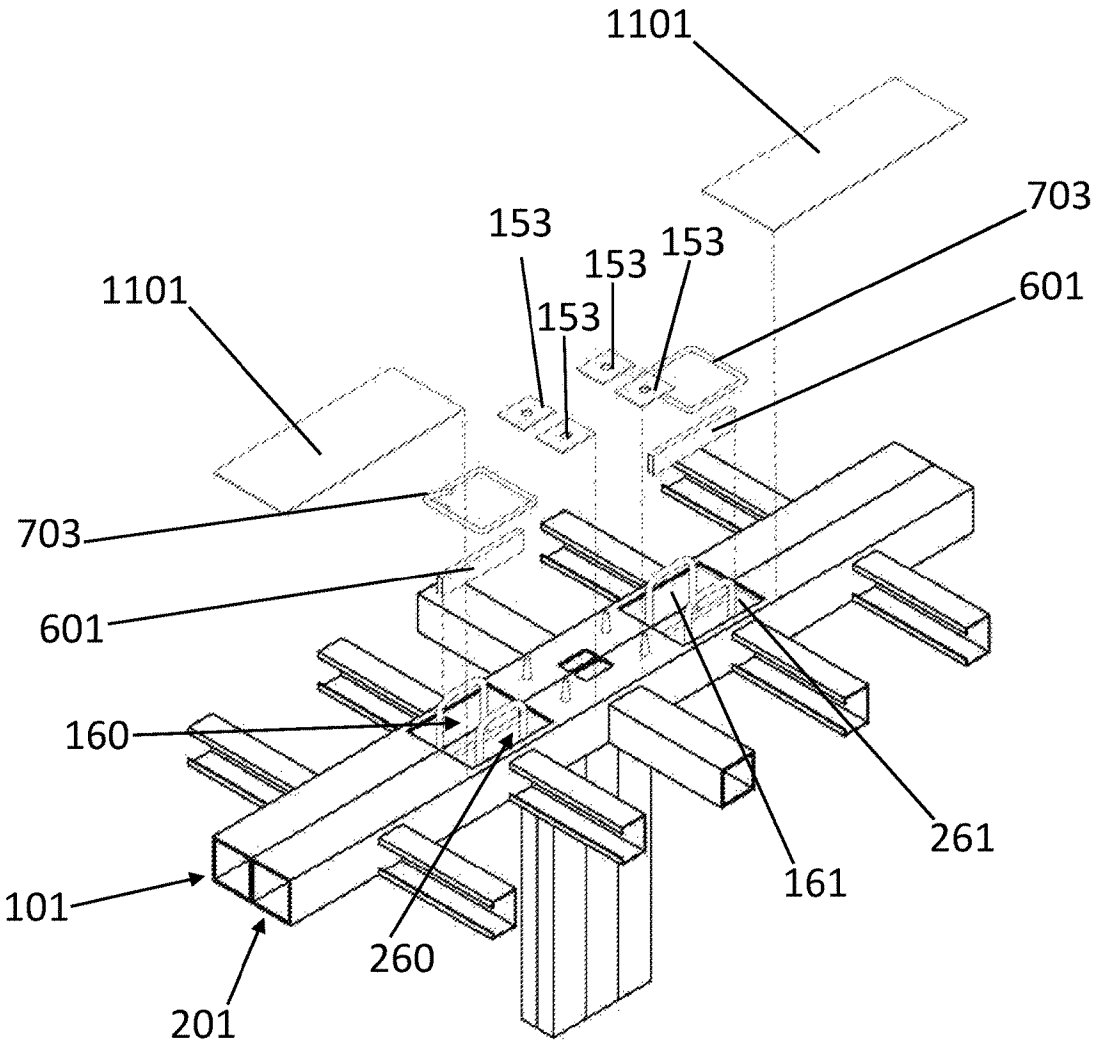
FIG. 12 shows an exploded view of the arrangement shown in FIG. 11.

FIG. 12 shows an exploded view of the arrangement of adjacent columns 113, 213 and upper beams 101, 201 of the two modular units 100, 200 shown in FIG. 11. The exploded view illustrates the coupling element 601 and the blanking plates 161, 261 that are positioned within the interior of the upper beams, 101 201 to define the chamber 160 inside the hollow interior of the upper beams 101, 201.

It will of course be appreciated that the arrangement of beams and columns described above and herein can be repeated at multiple positions around the structural frames, at which the columns are located, to form multiple connections to join together adjacent modular units.

Figure 13:
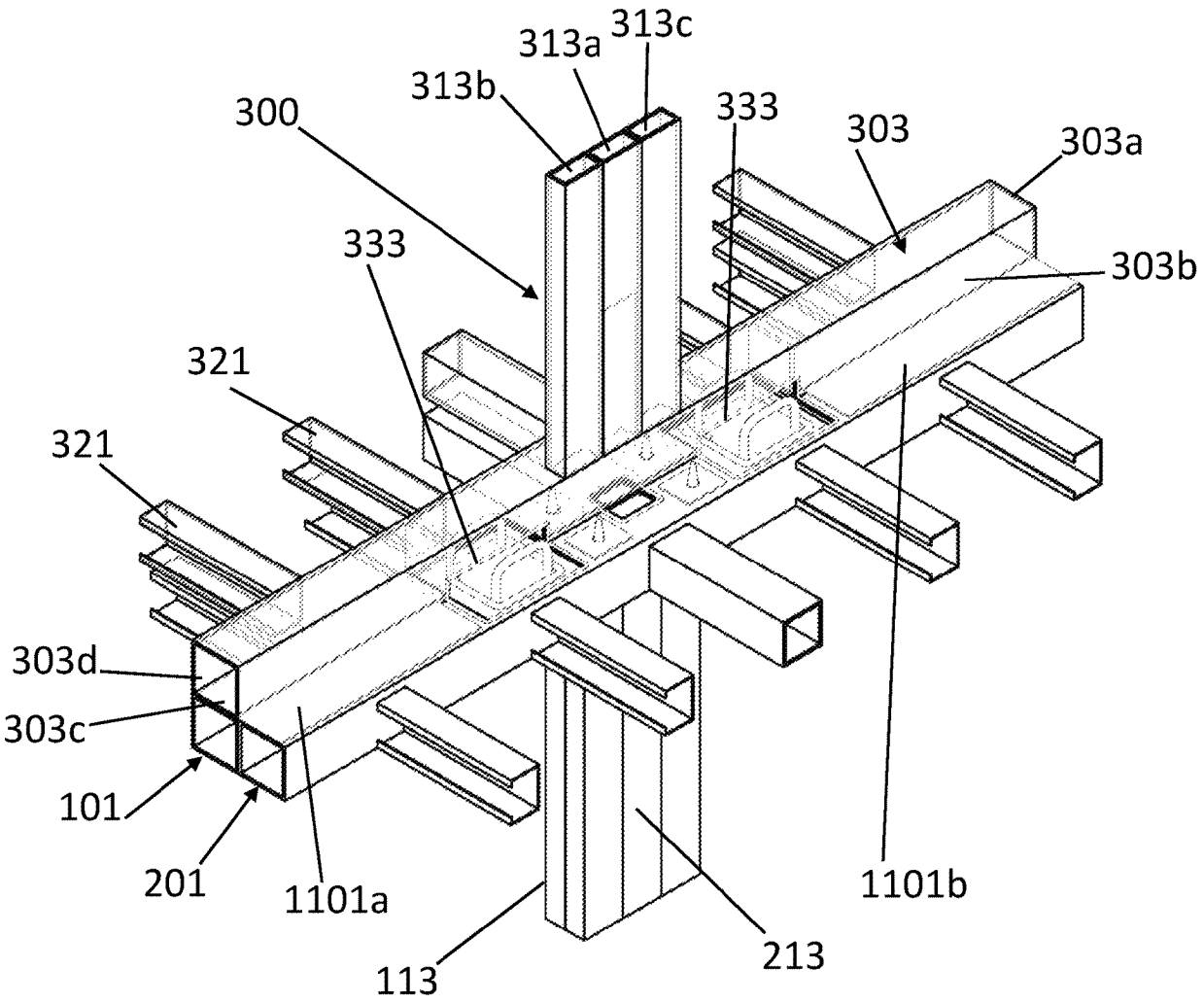
FIG. 13 shows a lower beam and columns of a third modular unit placed atop one of the first two adjacent modular units of the arrangement shown in FIG. 11.

FIG. 13 illustrates how a third modular unit 300 can be stacked atop the first modular unit 100 of the arrangement shown in FIG. 11, and a connection formed therebetween. The third modular unit 300 is, preferably, identical to the first modular unit 100, having openings 331 (as also described above) extending around the underside 303*c* and outer side 303*b* of its lower beam 303, which correspond in size and shape to the openings 131 that extend around the upper side 101*a* and outer side 101*b* of the upper beam 101 of the first modular unit 100. The third modular unit 300 may also have openings 331 that extend around the upper side 301*a* and outer side 301*b* of its upper beam 301, similar to the openings 131 of the first modular unit 100. As such, the first and third modular units 100, 300 may be substantially identical in construction principles. Modular units in accordance with the present invention can, however, be formed in a variety of shapes and dimensions and nonetheless be assembled together as described herein.

Locating holes (not shown) are formed in the underside 303*c* of the lower beam 303 of the third modular unit 300 at positions corresponding to the locations of the locating pins 151 provided on the upper side 101*a* of the upper beam 101 of the first modular unit 100. The locating holes of the lower beam 303 are adapted to receive the locating pins 151 to help ensure correct alignment of the third modular unit 300 relative to the first modular unit 100, and also to restrict lateral motion of the third modular unit 300 so as to allow the lower beam 303 to lie parallel to the upper beam 101 and flush with the resilient material 1101.

As mentioned above, openings 331 are formed in the underside 303*c* of the lower beam 303. The openings 331 correspond with the openings 131 provided in the upper beam 101 and therefore each extend around the edge of the lower beam 303 and across both the underside 301*c* and a portion of the outer side 301*b* of the lower beam 303. The openings 331 are formed with dimensions corresponding to those of the openings 131 that are formed in the beam 101, and are positioned so as to align with the openings 131 of the beam 101. The lifting eyes 135, 235 of the first modular unit 100 are received within by the openings 331, respectively, and further act to reinforce building material introduced into the chamber 360 (best shown in FIGS. 14 and 18) in the lower beam 303, as will be described further on.

Figure 14:
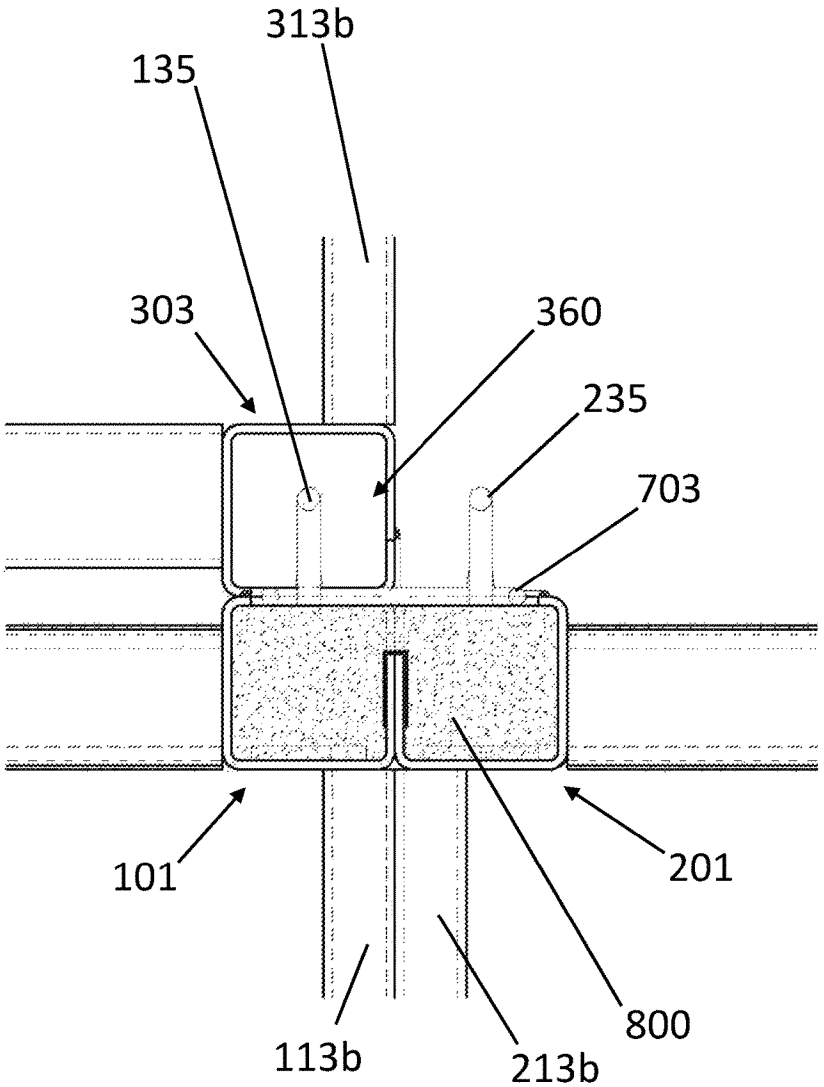
FIG. 14 shows a cross-sectional view of the arrangement shown in FIG. 13 taken through the beams showing building material contained within.

FIG. 14 shows a cross-sectional view of the arrangement of the first modular unit 100, second modular unit 200 and third modular unit 300 illustrated in FIG. 13 to form a connection "node". Building material, again here concrete, fills the chambers 160, 260 in the upper beams 101, 201 of the first and second modular units 100, 200 to form a hardened concrete block 800. The lifting eye 135 can be seen extending into the lower chamber 360 of the lower beam 303, through one of the openings 331 provided in the lower beam 303. A further reinforcing member 703 is positioned around the lifting eyes 135, 235 of the adjacent first and second modular units 100, 200, atop the concrete that has previously been introduced into the upper chambers 160, 260 of the upper beams 101, 201, to secure them together. The further reinforcing member 703 also acts to reinforce further building material introduced into the chamber 360 in the lower beam 303, as will be described further on.

Figure 15:
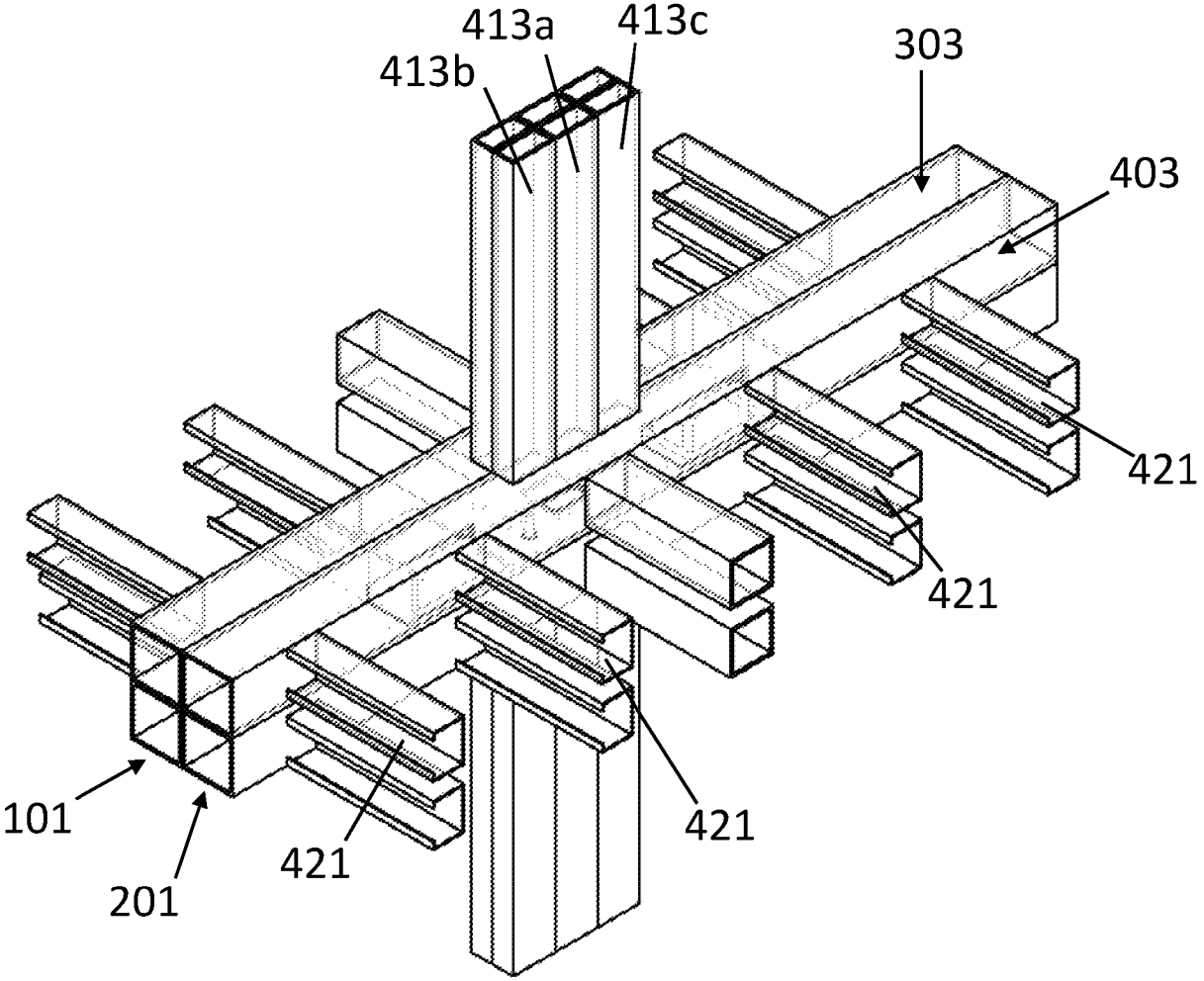
FIG. 15 shows a lower beam and columns of a fourth modular unit arranged side-by-side, in an adjacent configuration, with the third modular unit shown in FIG. 13, such that the fourth modular unit is atop the other of the first two adjacent modular units.

FIG. 15 shows how a fourth modular unit 400 can be stacked on top of the second modular unit 200, adjacent the third modular unit 300. Here, the fourth modular unit 400 is essentially identical to the second modular unit 200. Similar to the third modular unit 300, the fourth modular unit 400 includes a lower beam 403 having a set of openings (not shown) on its underside 403*c* and outer side 403*b* corresponding to the openings 231 on the upper side 201*a* of the upper beam 201 of the second modular unit 200. Locating holes (not shown) are also provided for receiving the locating pins 251 on the upper beam 201. The openings in the lower beam 403 are arranged to receive the lifting eyes 233 of the second modular unit 200 in the same way that the openings in the underside of the lower beam 303 of the third modular unit 300 receives the lifting eyes 135 of the first modular unit 100.

Figure 16:
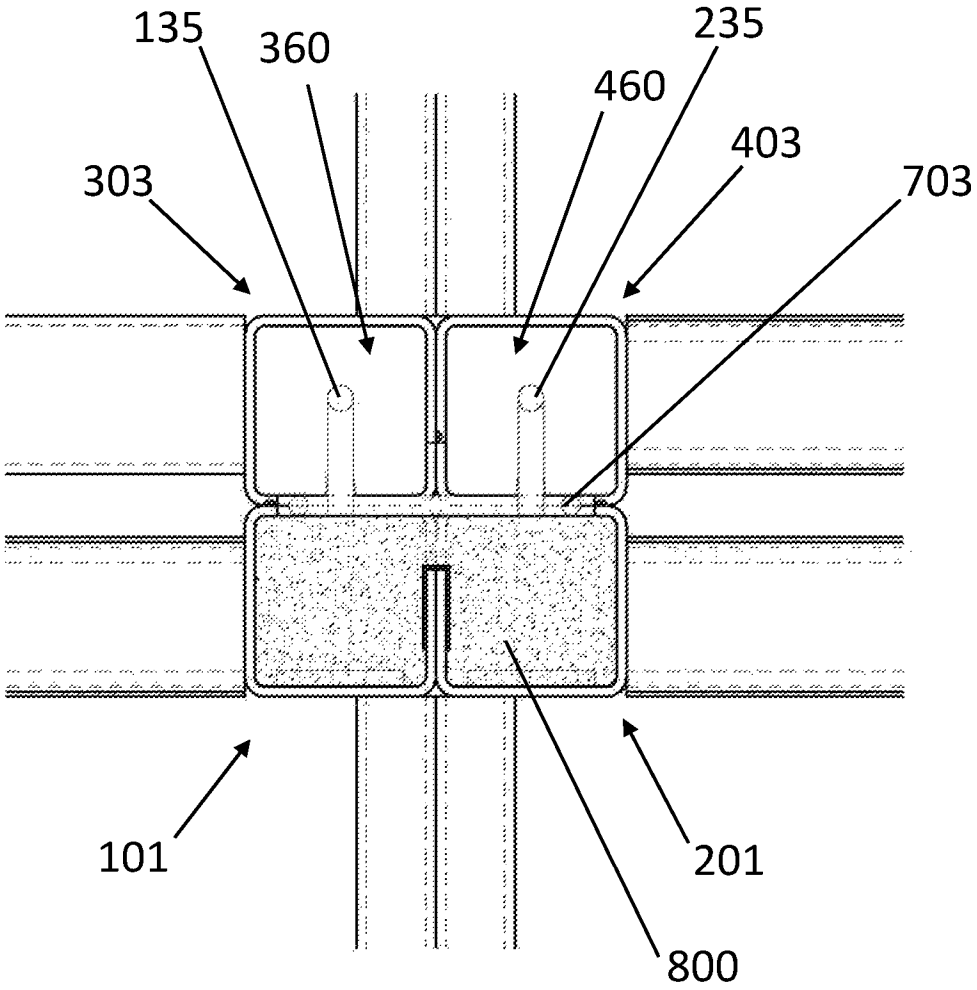
FIG. 16 shows a cross-sectional view of the arrangement shown in FIG. 15 taken through the beams showing building material contained within the first two modular units and the further reinforcing member installed, prior to the addition of additional building material.

Similar to FIG. 9, a cross-sectional view of a connection "node" formed at the junction of the four modular units 100, 200, 300, 400 is shown in FIG. 16, the modular units arranged as illustrated in FIGS. 14 and 15. It can clearly be seen how the lifting eyes 135, 235 on the upper beams 101, 201 of the first and second modular units 100, 200 extend into the lower chambers 360, 460 of the lower beams 303, 403 of the third and fourth modular units 300, 400.

As explained above, in the example shown, the third and fourth modular units 300, 400 are substantially identical to the first and second modular units 100, 200, respectively. Thus, the lower chamber 460 of the lower beam 403 and the middle column 413*a*, and similarly, the lower chamber 360 of the lower beam 303 and the column 313*a*, are in fluid communication. As with the first and second modular units 100, 200, the middle columns 313*a*, 413*a* of the third and fourth modular units 300, 400 are fluidly connected between the lower beams 303, 403 and upper beams (not shown).

To secure the modular units together, further building material, in this example concrete, is introduced, via fill holes provided in the upper beams (not shown) of the third and fourth modular units 300, 400, into the columns 313, 413, from where it flows into the lower chambers 360, 460. As the concrete fills the lower chambers 360, 460 it encases the protruding lifting eyes 135, 235 of the first and second modular units 100, 200 and any further reinforcing members 703 provided around the lifting eyes 135, 235. The further concrete introduced into the lower chambers 360, 460 of the third and fourth modular units 300, 400 bonds with the existing concrete contained in the upper chambers 160, 260 of the upper beams 101, 201 of the first and second modular units 100, 200, which existing concrete has at least partially hardened.

Figure 17:
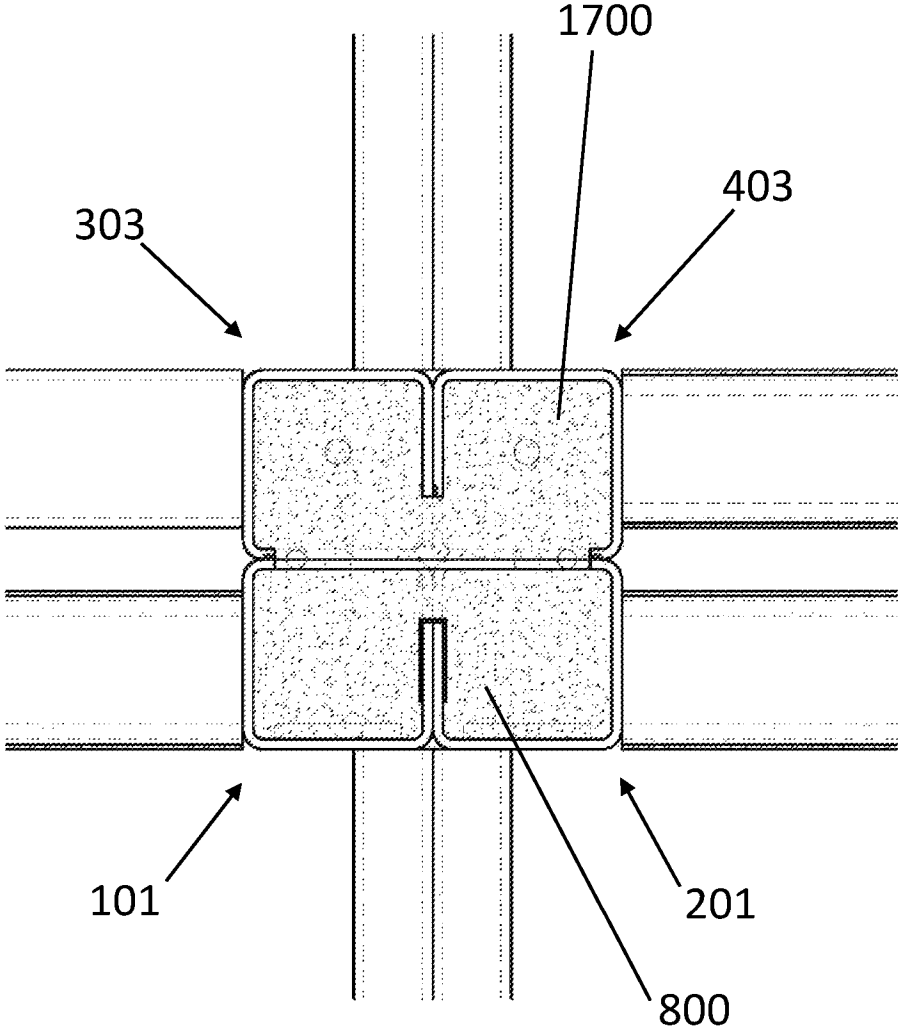
FIG. 17 shows the cross-sectional view of FIG. 16 with additional building material provided in the beams of the third and fourth modular units.

As shown in FIG. 17, once hardened, the concrete forms a continuous block 1700 that joins the modular units to one another, the concrete 1700 being reinforced by both the lifting eyes 135, 235 and reinforcing members 703 disposed in the lower chambers of the third and fourth modular units 300, 400. Sealant 701 provided around the openings 131, 231 and upper fill holes 141*a*, 241*a* in the upper beams 101, 201 of the first and second modular units 100, 200 acts to prevents leakage of concrete.

Figure 18:
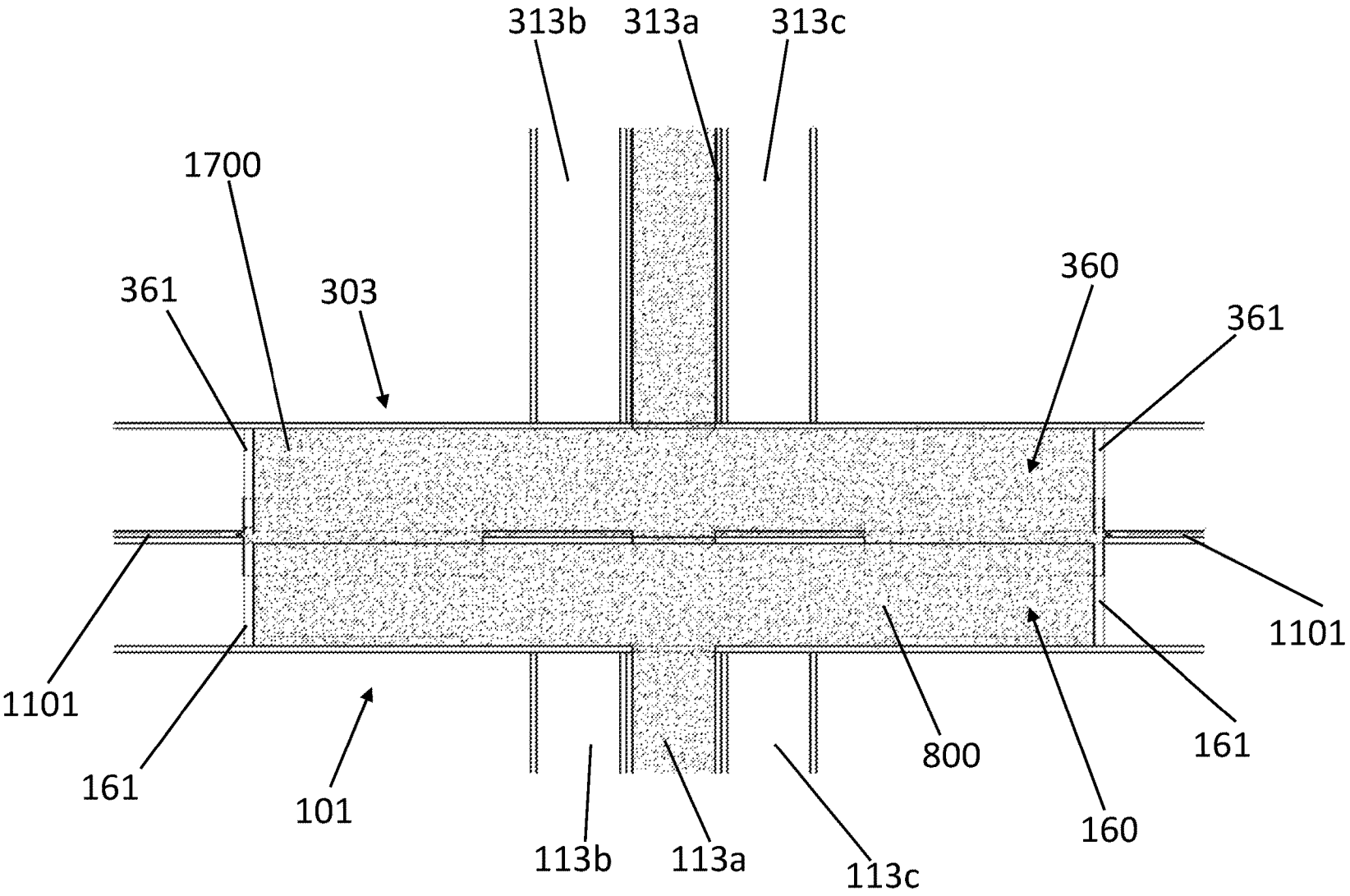
FIG. 18 shows a cross-sectional view of the arrangement shown in FIG. 15, from an angle perpendicular to the view shown in FIGS. 16 and 17, taken along a plane that passes through one of the columns.
Figure 19:
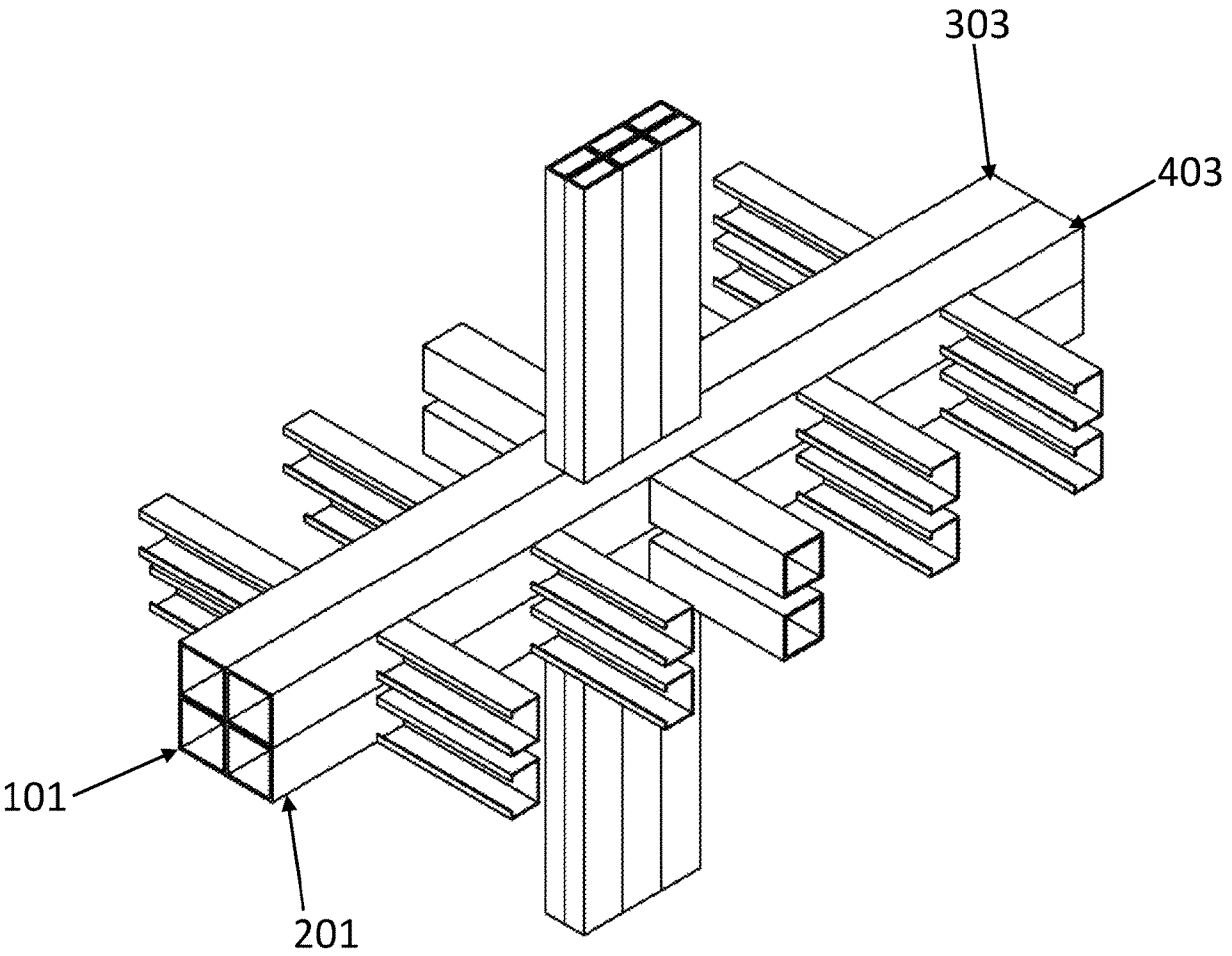
FIG. 19 shows an external view of the arrangement of FIG. 15.

Similar to FIG. 10, a cross-sectional view taken through the columns 113, 313 of the first and third modular units 100, 300 is shown in FIG. 18. As with the upper chambers 160, 260, the lower chambers 360, 460 are defined by blanking plates 361 secured into the lower beam 303 to define a partitioned space around the columns 313.

An external view of a connection "node" that joins the four structural units, as described above, is shown in FIG. 19. It will of course be appreciated that a plurality of such nodes may be provided along the sides of adjacent modular units to connect them together. Advantageously, no external fixings are required to secure the modular units together with the present invention, as can clearly be seen, because the building material can be inserted into the beams and columns of the structural frames (of each modular unit 100, 200, 300, 400) through the columns 313, 413 of the upper modular units 300, 400, for example via upper fill holes 341*a*, 441*a* (not shown) located in the upper beams 301, 401 (not shown) of the upper modular units 300, 400, similar to as described above in relation to connecting the two modular units 100, 300 in FIG. 8, for example.

While the foregoing is directed to exemplary embodiments of the present invention, other and further embodiments of the invention will be apparent to those skilled in the art from consideration of the specification, and may be devised without departing from the basic scope thereof, which is determined by the claims that follow.

The invention claimed is:

1. A modular unit for constructing a modular structure, comprising:

a structural frame including:

at least one upper beam;

at least one lower beam; and at least one column extending between said upper and lower beams and connected therebetween;

wherein at least one of said upper beams is arranged to define at least one chamber for receiving a building material therein along at least a portion of its length, said column being connected to said portion of said beam;

wherein part of said upper beam is removed along said portion of said upper beam to define at least one opening to said chamber, and wherein at least one element is provided in the chamber in the upper beam for securing thereto a means for lifting the modular unit, wherein said element extends out of an upper side of said beam; and wherein said beam in which said chamber is defined has a substantially rectangular cross-section defined by opposed upper and lower sides, and opposed inner and outer sides, and wherein said opening to said chamber extends at least partway around the outer side of said beam.

2. The modular unit of claim 1, wherein said beams and columns are hollow, and said column is connected therebetween such that a fluid connection is provided between said beams by said column.

3. The modular unit of claim 1, wherein said at least one opening to said chamber comprises a pair of openings spaced apart such that an opening is provided in said portion of said beam on either side of the column.

4. The modular unit of claim 1, wherein said opening extends around both the upper and outer sides of said upper beam and/or wherein said at least one beam is a lower beam, and said opening extends around both the lower and outer sides of said lower beam.

5. The modular unit of claim 1, wherein at least one of said chamber is defined in each of said upper beam and said lower beam such that said column fluidly connects the chamber in said upper beam with the chamber in said lower beam.

6. The modular unit of claim 4, wherein said element is a lifting-eye secured to the upper beam.

7. The modular unit of claim 6, wherein an aperture is provided in the upper side of said upper beam, said aperture being aligned with the hollow column that is fluidly connected to the upper beam so as to provide a direct fluid pathway into the column for the introduction of building material into the beam(s) and/or column via the aperture.

8. The modular unit of claim 1, wherein said column is positioned along a side or at a corner of the structural frame.

9. The modular unit of claim 1, further comprising a plurality of said columns extending between said upper and lower beam, and a plurality of said chambers are defined in said upper and/or lower beams, each of the plurality of said chambers being arranged in a portion of said beam to which a column is connected, wherein said plurality of columns are spaced apart along at least one side of the structural frame.

10. A modular structure, comprising:

a first modular unit and a second modular unit, each comprising:

a structural frame including at least one upper beam and at least one lower beam; and at least one column extending between said upper and lower beams and connected therebetween, wherein at least one of said upper or lower beams is arranged to define at least one chamber for receiving a building material therein along at least a portion of its length, said column being connected to said portion of said beam, and wherein part of said beam is removed along said portion of said beam to define at least one opening to said chamber, wherein the first and second modular units are connected together by building material contained within adjacently aligned chambers in said at least one upper and/or lower beams of each modular unit, the building material extending between said beams via said openings to said aligned chambers; and wherein said chambers of the first and second modular units are defined in the upper beams of the first and second modular units, and wherein an element is provided in each of said chambers for securing thereto a means for lifting the respective modular unit, the structure further comprising a reinforcing member provided around both of said elements in the adjacent chambers so as to secure said elements together.

11. The modular structure of claim 10, wherein the first and second modular units are connected together such that said beams, in which said chambers are defined in each of the modular units, are adjacent with said chambers and their openings aligned.

12. The modular structure of claim 10, wherein said chambers are defined in the upper beam of each modular unit.

13. The modular structure of claim 10, wherein said chambers are defined in the lower beam of each modular unit.

14. The modular structure of claim 10, further comprising a third modular unit arranged on top of the first modular unit such that an opening of a chamber defined in a lower beam of the third modular unit is aligned with the opening of a chamber defined in the upper beam of the first modular unit.

15. The modular structure of claim 14, further comprising a fourth modular unit arranged on top of the second modular unit and adjacent the third modular unit such that an opening of a chamber defined in a lower beam of the fourth modular unit is aligned with both the opening of a chamber defined in the upper beam of the second modular unit and the opening of the chamber defined in the lower beam of the third modular unit.

16. The modular structure of claim 10, wherein each of said adjacently aligned chambers in said adjacent beams contains building material that extends between the adjacent chambers via the aligned openings in said beams so as to connect the first and second modular units.

17. A method of connecting together at least two modular units to construct a modular structure, the method comprising:

providing a first and second modular unit, each comprising:

a structural frame including at least one upper beam and at least one lower beam; and at least one column extending between said upper and lower beams and connected therebetween, wherein at least one of said upper or lower beams is arranged to define at least one chamber for receiving a building material therein along at least a portion of its length, said column being connected to said portion of said beam, and wherein part of said beam is removed along said portion of said beam to define at least one opening to said chamber, aligning the first and second modular unit such that they are adjacent with said chambers and openings in said beams adjacently aligned; and introducing a building material into said adjacent chambers, wherein the building material extends between the adjacent chambers via said openings to form a connection when the building material hardens; and wherein said chambers of the first and second modular units are defined in the upper beams of the first and second modular units, and wherein an element is provided in each of said chambers for securing thereto a means for lifting the respective modular unit, the structure further comprising a reinforcing member provided around both of said elements in the adjacent chambers so as to secure said elements together.

18. The method according to claim 17, wherein the building material is concrete.

* * * * *